US006449962B1

(12) United States Patent
Takemasa et al.

(10) Patent No.: US 6,449,962 B1
(45) Date of Patent: Sep. 17, 2002

(54) REFRIGERANT COLLECTING DEVICE, REFRIGERANT COLLECTING METHOD, REFRIGERATOR HAVING REFRIGERANT COLLECTING DEVICE, CONTROL METHOD FOR REFRIGERANT IN REFRIGERANT CIRCUIT OR REGENERATION DEVICE AND REGENERATION METHOD FOR REFRIGERANT COLLECTING

(75) Inventors: Kazuo Takemasa, Gunma (JP); Takayuki Shimizu, Saitama (JP); Jiro Yuzawa, Gunma (JP); Katsuhiko Inoue, Gunma (JP); Fukuji Yoshida, Gunma (JP); Yonezo Ikumi, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/485,638

(22) PCT Filed: Jun. 11, 1999

(86) PCT No.: PCT/JP99/03133

§ 371 (c)(1),
(2), (4) Date: Feb. 11, 2000

(87) PCT Pub. No.: WO99/64799

PCT Pub. Date: Dec. 16, 1999

(30) Foreign Application Priority Data

| | | |
|---|---|---|
| Jun. 11, 1998 | (JP) | 10-163789 |
| Jun. 11, 1998 | (JP) | 10-163790 |
| Jun. 11, 1998 | (JP) | 10-163795 |
| Aug. 31, 1998 | (JP) | 10-245589 |
| Aug. 31, 1998 | (JP) | 10-245595 |
| Aug. 31, 1998 | (JP) | 10-245601 |

(51) Int. Cl.[7] ..... F25B 45/00
(52) U.S. Cl. ..... 62/77; 62/292
(58) Field of Search ..... 62/292, 77

(56) References Cited

U.S. PATENT DOCUMENTS

| | | | | | |
|---|---|---|---|---|---|
| 5,165,247 | A | * | 11/1992 | Rockenfeller et al. | 62/77 |
| 5,275,013 | A | * | 1/1994 | Price et al. | 62/292 |
| 5,289,690 | A | * | 3/1994 | Rockenfeller et al. | 62/77 |
| 5,293,756 | A | * | 3/1994 | Nelson et al. | 62/292 |
| 5,392,610 | A | * | 2/1995 | Nelson et al. | 62/77 |
| 5,540,254 | A | * | 7/1996 | McGown et al. | 167/315 |
| 5,544,492 | A | * | 8/1996 | Manz | 62/85 |
| 5,645,104 | A | * | 7/1997 | Baumgartner | 137/318 |
| 5,699,678 | A | * | 12/1997 | Trigiani | 62/292 |
| 5,915,402 | A | * | 6/1999 | Mitchell, II | 137/15 |

* cited by examiner

*Primary Examiner*—William C. Doerrler
*Assistant Examiner*—Mark Shulman
(74) *Attorney, Agent, or Firm*—Darby & Darby

(57) ABSTRACT

There is disclosed an apparatus for easily recovering a refrigerant from a refrigerant circuit of a refrigeration apparatus at a low cost. A refrigerant recovery apparatus 6A is provided with a pipeline 7 for connection to the refrigerant circuit, a valve 17 with a clamping/piercing function disposed on the tip end of this pipeline 7, and a refrigerant recovery main body 10A containing a solid adsorbent 9 which can selectively adsorb the refrigerant, and the clamping/piercing function valve 17 is attached to the refrigerant circuit to make a small hole in the refrigerant circuit so that the refrigerant is adsorbed/recovered to the solid adsorbent 9.

19 Claims, 24 Drawing Sheets

REFRIGERANT COLLECTING DEVICE, REFRIGERANT COLLECTING METHOD, REFRIGERATOR HAVING REFRIGERANT COLLECTING DEVICE, CONTROL METHOD FOR REFRIGERANT IN REFRIGERANT CIRCUIT OR REGENERATION DEVICE AND REGENERATION METHOD FOR REFRIGERANT COLLECTING

TECHNICAL FIELD

The present invention relates to a refrigerant recovery apparatus, a refrigerant recovery method, a refrigeration apparatus provided with the refrigerant recovery apparatus, a control method of a refrigerant in a refrigerant circuit or a recycling apparatus and a recycling method of the refrigerant recovery apparatus.

BACKGROUND ART

Used as conventional refrigerants of refrigeration apparatuses such as a refrigerator are R-500 comprising dichlorodifluoromethane (R-12) having a danger of damaging the ozone layer or an azeotropic mixture refrigerant R-12 and 1,1-difluoroethane (R-152a); substitute refrigerants for reducing the content of chlorine groups having less danger of damaging the ozone layer but having a high earth warming effect, such as chlorodifluoromethane (HCFC-22); refrigerants containing no chlorine groups such as difluoromethane (HFC-32, R-32), trifluoromethane (HFC-23, R-23), pentafluoroethane (HFC-125, R-125), 1,1,1,2-tetrafluoroethane (HFC-134a, R-134a), and 1,1,1-trifluoroethane (HFC-143a, R-143a); fluorocarbonic refrigerants containing neither chlorine group nor hydrogen (FC refrigerant); the mixture of these refrigerants; combustible hydrocarbons such as propane, butane, and pentane; helium; ammonia; and air.

Because a household refrigerator, an air conditioner, or an industrial refrigeration apparatus using these refrigerants has been used up and for other reasons, the refrigerants need to be recovered from the refrigerant circuit, then a refrigerant recovery machine is used to perform a method of attracting the refrigerant, discharging the refrigerant to the outside of the refrigerant circuit, and liquefying and placing the refrigerant into a bomb or the like.

However, this method is convenient when a large number of the used household refrigerators, and the like are collected and treated in the place where the refrigerant recovery machine is installed, but the refrigeration apparatuses such as the refrigerator in a remote area, the industrial refrigeration apparatuses, particularly medical apparatuses with special refrigerants sealed therein are collected with difficulty. Additionally, it is troublesome and laborious to convey the large and heavy refrigerant recovery machine to the remote area, which causes a problem of an increase in costs.

The present invention solves the above-described problems, and an object of the present invention is to provide a refrigerant recovery apparatus which can be used for recovering a refrigerant or a foaming agent by connecting the apparatus to the bomb containing the refrigerant, the container containing the foaming agent recovered from urethane foam, and the like (Freon, and the like used as the refrigerants are used as the foaming agents), and the like; or a small-sized and portable refrigerant recovery apparatus which can easily and inexpensively recover various refrigerants, such as the Freon refrigerants, hydrocarbons, helium, ammonia, and air, present in the refrigerant circuits of the refrigeration apparatuses such as the used household refrigerator and the industrial refrigeration apparatus. Another object of the present invention is to provide a method of using the refrigerant recovery apparatus to easily recover the various refrigerants from the refrigerant circuit of the refrigeration apparatus at low costs. Further object of the present invention is to provide a refrigeration apparatus provided with the refrigerant recovery apparatus.

Another object of the present invention is to provide an apparatus for recycling the refrigerant recovery apparatus provided with a refrigerant recovery main body containing a solid adsorbent having adsorbed the refrigerant of the refrigerant circuit and a recycling method.

Still another object of the present invention is to provide a refrigeration apparatus in which when the refrigerant leaks from the refrigerant circuit of the refrigeration apparatus, thereby causing a danger of adverse influence, and particularly when the refrigerants are combustible hydrocarbons such as propane, butane, and pentane and natural refrigerants such as ammonia, the refrigerants in the refrigerant circuit of the refrigeration apparatus are immediately recovered to the refrigerant recovery apparatus, so that the danger can be prevented beforehand.

DISCLOSURE OF THE INVENTION

Specifically, to solve the above-described problems, according to the present invention, there is provided a refrigerant recovery apparatus connected to a refrigerant circuit for recovering a refrigerant, which comprises a pipeline for connection to the refrigerant circuit, a valve with a clamping/piercing function disposed on the tip end of the pipeline, and a refrigerant recovery main body containing a solid adsorbent which can selectively adsorb the refrigerant. By attaching the valve with the claming/piercing function to the refrigerant circuit and making a small hole in the refrigerant circuit, the refrigerant is adsorbed/recovered to the solid adsorbent.

Moreover, in the refrigerant recovery apparatus of the present invention, the refrigerant recovery main body is color-coded in accordance with a refrigerant type which can be adsorbed.

Furthermore, the refrigerant recovery apparatus of the present invention comprises two or more refrigerant recovery main bodies so that the solid adsorbent able to selectively adsorb different refrigerants are contained in different refrigerant recovery main bodies.

Additionally, the refrigerant recovery apparatus of the present invention comprises the refrigerant recovery main body in which a plurality of solid adsorbents able to selectively adsorb different refrigerants are contained in one refrigerant recovery main body.

Moreover, in the refrigerant recovery apparatus of the present invention, the solid adsorbent is selected from the group consisting of powdery, particulate, fibrous, and molded active carbon, gas adsorbent resin, clay, active alumina, molecular sieve, bone charcoal, China clay, silica gel, and the mixture of two or more of these components.

Furthermore, in the refrigerant recovery apparatus of the present invention, the refrigerant recovery main body can be structured so that air-cooling and/or water-cooling can be performed.

According to the present invention, a refrigeration apparatus is provided beforehand with any one of the above-described refrigerant recovery apparatuses.

Furthermore, according to the present invention, a recycling apparatus of the refrigerant recovery apparatus further comprises a heating apparatus for heating the refrigerant recovery main body or the refrigerant recovery apparatus having adsorbed the refrigerant, a pipeline with one end connected to the refrigerant recovery main body for discharging a desorbed refrigerant, a cooling apparatus disposed midway in the pipeline, and a refrigerant container connected to the other end of the pipeline.

Moreover, the method of recycling the refrigerant recovery apparatus of the present invention comprises the steps of heating the refrigerant recovery main body containing the solid adsorbent having adsorbed the refrigerant to a temperature of 500° C or more to desorb the adsorbed refrigerant, cooling and liquefying the desorbed refrigerant, and recovering the liquefied refrigerant to the refrigerant container.

According to the present invention, there is provided a refrigeration apparatus provided with a refrigerant recovery apparatus comprising a pipeline connected to a refrigerant circuit, an opening/closing valve disposed on the pipeline, and a refrigerant recovery main body connected to the pipeline for containing a solid adsorbent which can selectively adsorb a refrigerant in the refrigerant circuit. When at least one sensor disposed in spaces such as the refrigeration apparatus and/or a room in which the refrigeration apparatus is installed detects the refrigerant leaking from the refrigerant circuit, the opening/closing valve is opened based on a signal from the sensor to connect the refrigerant circuit and the refrigerant recovery apparatus, and the refrigerant in the refrigerant circuit is adsorbed to the solid adsorbent.

Furthermore, in the refrigeration apparatus of the present invention, the refrigerants are natural refrigerants such as hydrocarbons including ammonia, propane, and butane.

Moreover, the refrigerant contains an index substance.

Furthermore, the refrigeration apparatus of the present invention comprises an alarm lamp and/or an alarm buzzer. When the sensor detects the refrigerant leaking from the refrigerant circuit, the alarm lamp and/or the alarm buzzer is operated based on the signal from the sensor.

In the refrigerant recovery apparatus of the present invention, a solid adsorbent is contained in a sealed container, and a vacuum is drawn inside the sealed container.

In the refrigerant recovery apparatus of the present invention, the sealed container comprises a pipeline on the tip end of which a valve provided with a clamping/piercing function is disposed.

According to the present invention, there is provided a refrigerant recovery method which comprises the steps of: containing a solid adsorbent in a sealed container; connecting a refrigerant recovery apparatus in which a vacuum is drawn inside the sealed container to a refrigerant circuit; and adsorbing and recovering a refrigerant in the refrigerant circuit.

According to the present invention, there is provided a refrigerant recovery apparatus which comprises: a pipeline connected to a refrigerant circuit; a refrigerant recovery main body connected to the pipeline for containing a solid adsorbent which can adsorb/desorb a refrigerant in the refrigerant circuit; and heating means for heating the solid adsorbent.

Moreover, the pipeline comprises an opening/closing valve.

Furthermore, the refrigerant in the refrigerant circuit comprises a hydrocarbon fluoride refrigerant and/or a hydrocarbon refrigerant.

Additionally, the refrigerant in the refrigerant circuit comprises a mixture refrigerant, and the solid adsorbent selectively adsorbs a predetermined refrigerant among the mixture refrigerant.

Moreover, the solid adsorbent is provided with a selective adsorptivity by depositing ultrafine particles through coating.

Furthermore, the heating means utilizes the heat of a discharge refrigerant of a compressor in the refrigerant circuit.

Additionally, a temperature sensor is disposed in an evaporator in the refrigerant circuit, and when the temperature sensor detects a lack of refrigeration ability of the evaporator, the opening/closing valve disposed in the pipeline is opened based on the signal from the sensor and the total amount of refrigerants in the refrigerant circuit are adsorbed to the solid adsorbent.

According to the present invention, there is provided a control method of a refrigerant in a refrigerant circuit which comprises the steps of: connecting a refrigerant recovery main body containing a solid adsorbent which can adsorb/desorb the refrigerant to a refrigerant circuit; and adsorbing/desorbing the refrigerant in the refrigerant circuit to control a refrigerant amount in the refrigerant circuit.

Moreover, an opening/closing valve is disposed between the refrigerant recovery main body containing the solid adsorbent and the refrigerant circuit, and the opening/closing valve is opened to adsorb a part of the refrigerant.

Furthermore, the solid adsorbent having adsorbed the refrigerant is heated by heating means to desorb the refrigerant, and the refrigerant is returned to the refrigerant circuit.

Additionally, the refrigerant comprises a mixture refrigerant, and at least one type of refrigerant in the mixture refrigerant is selectively adsorbed to the solid adsorbent.

Moreover, the refrigerant comprises a mixture refrigerant constituted of a combustible refrigerant and an incombustible refrigerant, the combustible refrigerant is selectively adsorbed to the solid adsorbent, and the mixture refrigerant is set to an incombustible area.

According to the present invention, there is provided a refrigerant recovery apparatus which comprises a refrigerant recovery main body containing a solid adsorbent which can adsorb at least one refrigerant selected from the group consisting of R23, R116 and R508 in a container.

Moreover, according to the present invention, there is provided a refrigerant recovery apparatus connected to a refrigerant circuit for recovering a refrigerant, which comprises a pipeline for connection to the refrigerant circuit, an opening/closing valve disposed on the pipeline, and a refrigerant recovery main body containing a solid adsorbent which can adsorb at least one refrigerant selected from the group consisting of R23, R116 and R508. The pipeline is connected to the refrigerant circuit and the opening/closing valve is opened to adsorb and recover the refrigerant to the solid adsorbent.

BEST MODE FOR CARRYING OUT THE INVENTION

Embodiments of the present invention will be described hereinafter with reference to the drawings.

Figure 1:
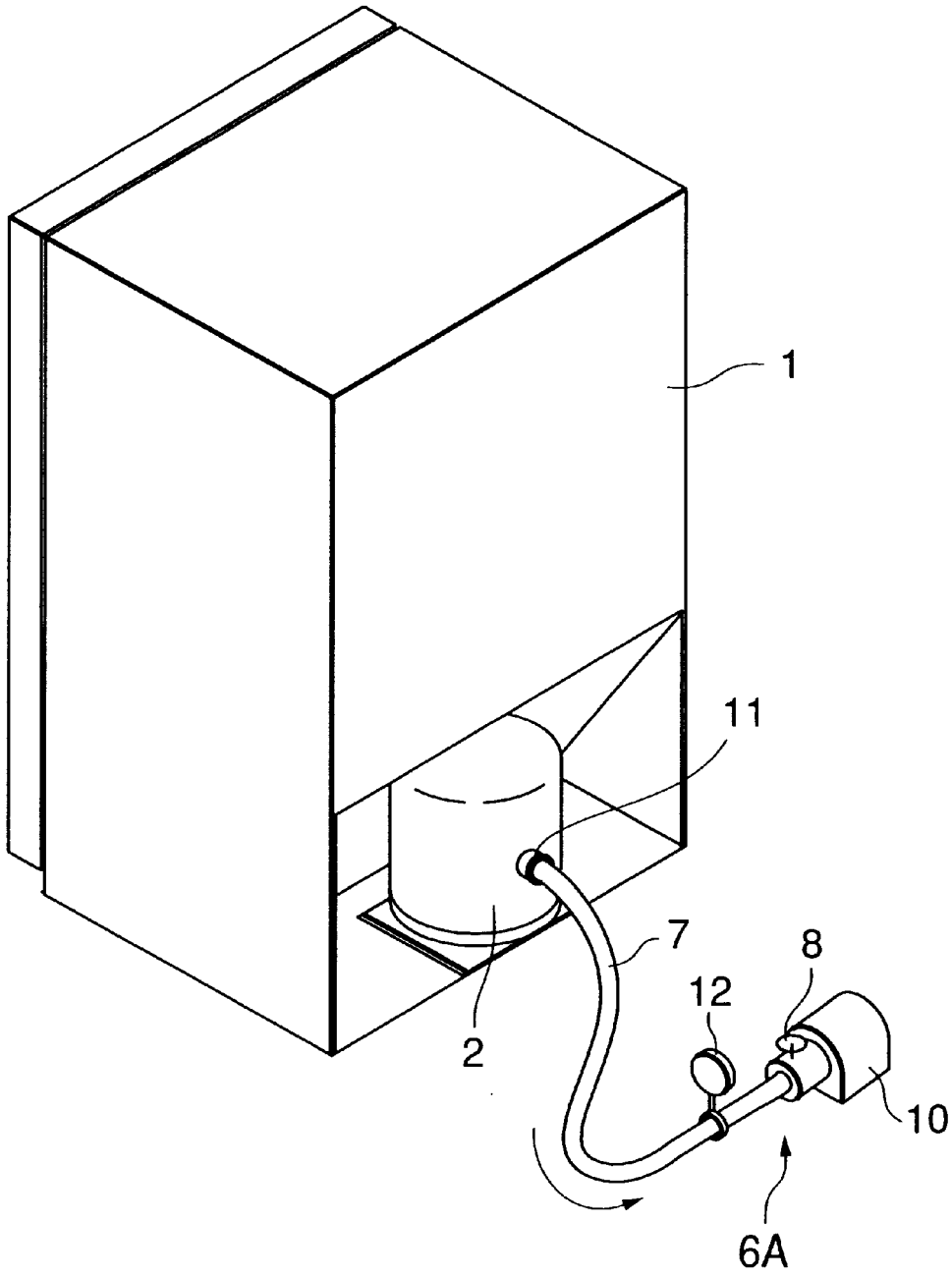
FIG. 1 is an explanatory view showing that a refrigerant recovery apparatus according to one embodiment of the present invention is connected to a refrigerator.
Figure 2:
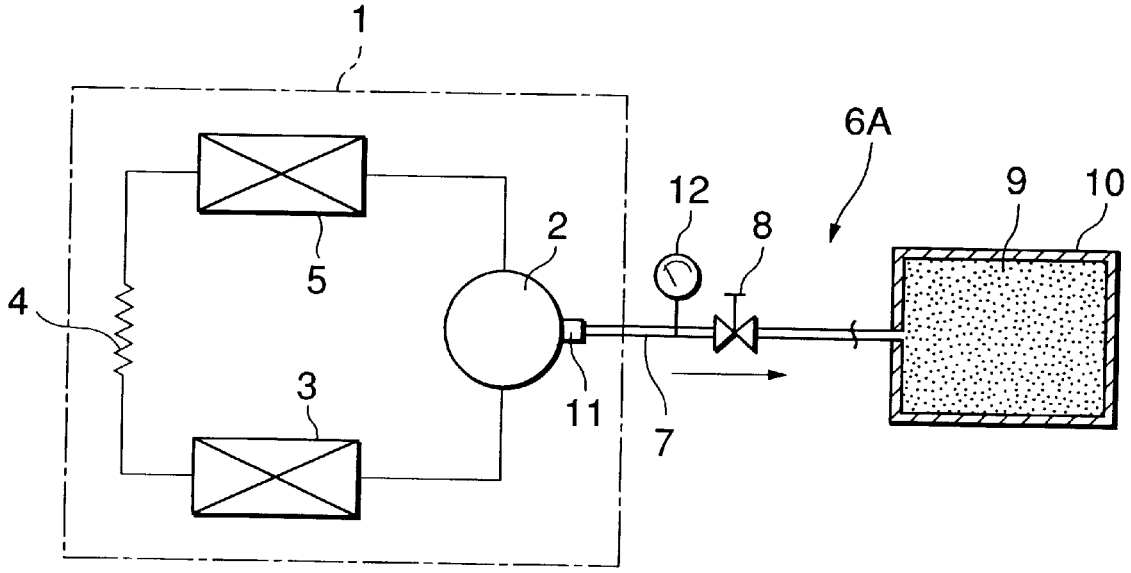
FIG. 2 is an explanatory view showing that the refrigerant recovery apparatus of the present invention is connected to a refrigerant circuit of the refrigerator shown in FIG. 1.

FIG. 1 is an explanatory view showing that a refrigerant recovery apparatus according to one embodiment of the present invention is connected to a refrigerator. FIG. 2 is an explanatory view showing that the refrigerant recovery apparatus of the present invention is connected to a refrigerant circuit of the refrigerator shown in FIG. 1.

In FIGS. 1 and 2, numeral 1 denotes a refrigerator with a compressor 2 mounted thereon. The compressor 2 is successively connected to a condenser 3, a capillary tube 4 and an evaporator 5 to constitute a refrigerant circuit. A refrigerant recovery apparatus 6A is connected to the compressor 2 in this refrigerant circuit. The refrigerant recovery apparatus 6A is constituted of a pipeline 7 for connection to the refrigerant circuit, an opening/closing valve 8 disposed on the pipeline 7, a refrigerant recovery main body 10 containing a solid adsorbent 9 which can selectively adsorb the refrigerants in the refrigerant circuit, and the like. One end of the pipeline 7 is connected to the tip end of a seal pipe 11 for sealing the refrigerants to the compressor 2 of the refrigerant circuit. Numeral 12 denotes a pressure gauge.

The refrigerant recovery apparatus 6A is simple in constitution, small in size and portable, can easily be conveyed and installed, and is easy to handle and operate.

In the above-described constitution, in the case in which the refrigerants in the refrigerant circuit (e.g., the Freon refrigerants, hydrocarbons, helium, ammonia, air, and the like) need to be recovered because the refrigerator 1 has been used up and for other reasons, by opening the opening/closing valve 8, the refrigerants flow in the direction shown by an arrow and are adsorbed to the solid adsorbent 9 without using any suction pump or the like. Therefore, substantially all the refrigerants in the refrigerant circuit can be recovered into the refrigerant recovery main body 10.

In the present invention, the solid adsorbent 9 needs to be used in accordance with the refrigerants present in the refrigerant circuit so that the refrigerants can be adsorbed by the solid adsorbent. Concretely, when the refrigerant present in the refrigerant circuit is Freon refrigerant, the solid adsorbent having the adsorptive performance to adsorb the Freon refrigerants needs to be used. When the refrigerants present in the refrigerant circuit are hydrocarbons, helium, ammonia, air, and the like, the solid adsorbent having the adsorptive performance to adsorb the refrigerants need to be used.

The solid adsorbent which can adsorb the refrigerants is selected from the group consisting of powdery, particulate, fibrous, and molded active carbon, gas adsorbent resin, clay, active alumina, molecular sieve, bone charcoal, China clay and silica gel, and the mixture of two or more of these components in consideration of the type, small hole size, polarity, and the like of the solid adsorbent.

The active carbon can preferably be used among these. Any powdery active carbon, any granulated active carbon, or any refrigerant formed of carbonic materials such as coconut shell, coal, petroleum pitch, and oil carbon can be used. A fine powder active carbon can more preferably be used among the active carbons because it is superior in refrigerant adsorptivity. The specific surface area of the particulate active carbon according to the BET method is 400 $m^2/g$ or more, preferably 1000 $m^2/g$ or more, particularly preferably 2000 $m^2/g$ or more.

In Freon refrigerants, for example, R23 has a molecular weight of 70 and a boiling point of −82° C., R116 has a molecular weight of 138 and a boiling point of −78° C., and the physical properties are different. Therefore, for example, when the active carbon is used as the solid adsorbent, as the active carbon which can selectively adsorb R23 refrigerant, the active carbon with small-diameter pores is selected, and as the active carbon which can selectively adsorb R116 refrigerant, the active carbon with large-diameter pores is selected Moreover, when the mixture refrigerant R-508 containing 61% of R23 and 39% of R116 is adsorbed/recovered, as the active carbon which can selectively adsorb R-508, the mixture of a predetermined ratio of the active carbon with small-diameter pores and the active carbon with large-diameter pores can be contained in the refrigerant recovery main body 10 and used.

Figure 3:
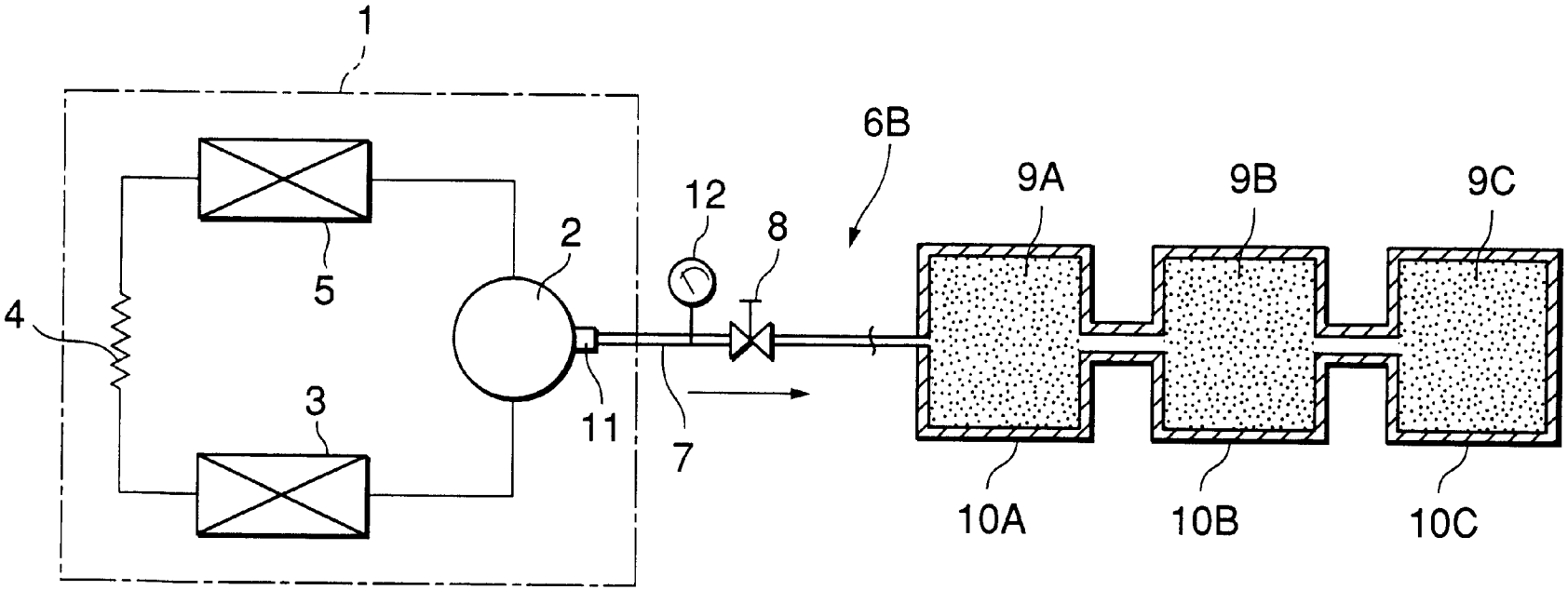
FIG. 3 is an explanatory view showing that another refrigerant recovery apparatus of the present invention is connected to the refrigerant circuit of the refrigerator shown in FIG. 1.

Furthermore, as shown in FIG. 3, for example, when the mixture refrigerant of three A, B and C refrigerants is adsorbed/recovered, a solid adsorbent 9A which can selectively adsorb the A refrigerant is contained in a refrigerant recovery main body 10A, a solid adsorbent 9B which can selectively adsorb the B refrigerant is contained in a refrigerant recovery main body 10B, a solid adsorbent 9C which can selectively adsorb the C refrigerant is contained in a refrigerant recovery main body 10C, the refrigerant recovery main bodies 10A, 10B and 10C are connected in series and used, and the mixture refrigerant formed of the A, B and C refrigerants can be adsorbed/recovered by adsorbing the A refrigerant to the solid adsorbent 9A, the B refrigerant to the solid adsorbent 9B, and the C refrigerant to the solid adsorbent 9C.

When the refrigerant recovery main bodies 10A, 10B, 10C are color-coded, the type of the refrigerant which can selectively be adsorbed can conveniently be known by the color, and the refrigerant recovery main bodies to be combined for use when the mixture refrigerant is adsorb/recovered can easily be selected.

Figure 4:
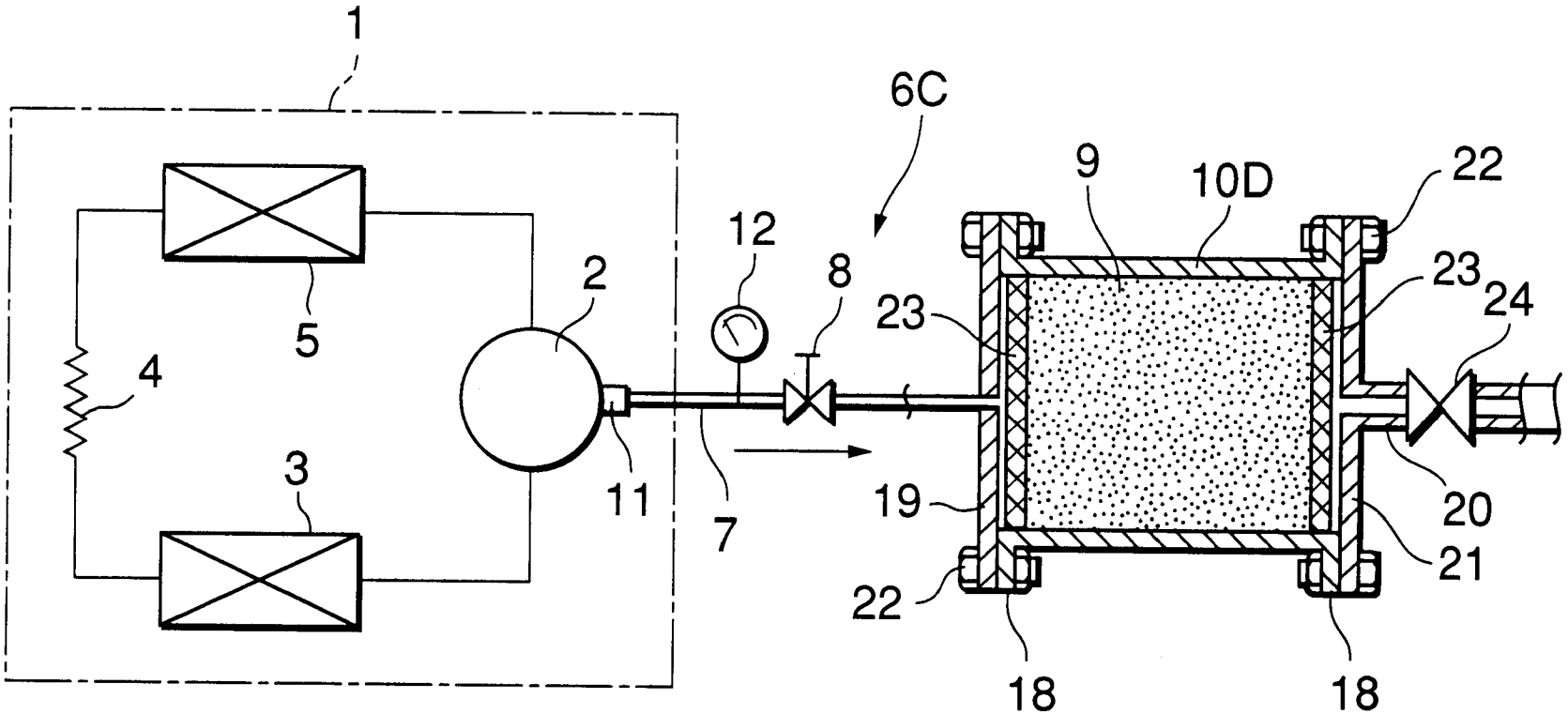
FIG. 4 is an explanatory view showing that another refrigerant recovery apparatus of the present invention is connected to the refrigerant circuit of the refrigerator shown in FIG. 1.

Furthermore, the refrigerant recovery main body (10D in this case) is preferably disposed so that it can easily be attached/detached as shown in FIG. 4. The refrigerant recovery main body 10D is provided with flange portions 18 on left and right end portions, and the refrigerant recovery main body 10D is fixed by fixtures 22 such as bolts and nuts between a flange portion 19 disposed on one end of the pipeline 7 and a flange portion 21 disposed on one end of another pipeline 20. Numeral 23 denotes a filter for filtering foreign matters such as rust, and 24 denotes an opening/closing valve disposed on the other pipeline 20.

In the constitution of FIG. 4, in the case in which the refrigerants in the refrigerant circuit (e.g., the Freon refrigerants, hydrocarbons, helium, ammonia, air, and the like) need to be recovered because the refrigerator 1 has been used up and for other reasons, the opening/closing valve 24 remains to be closed, the opening/closing valve 8 is opened, then the refrigerants flow in the direction shown by the arrow and are adsorbed to the solid adsorbent 9 without using the suction pump, so that substantially all the refrigerants in the refrigerant circuit can be recovered in the refrigerant recovery main body 10D.

When the solid adsorbent 9 having adsorbed the refrigerants in the refrigerant recovery main body 10D needs to be changed, incinerated/discarded, or recycled, the fixtures 22 are removed to take the refrigerant recovery main body 10D from a refrigerant recovery apparatus 6C, and the filter 23 is taken from the taken refrigerant recovery main body 10D so that the solid adsorbent 9 can easily be taken out. A new solid adsorbent 9 or a recycled solid adsorbent 9 is contained in the refrigerant recovery main body 10D and can easily be attached to the refrigerant recovery apparatus 6C in the procedure reverse to the above.

Figure 5:
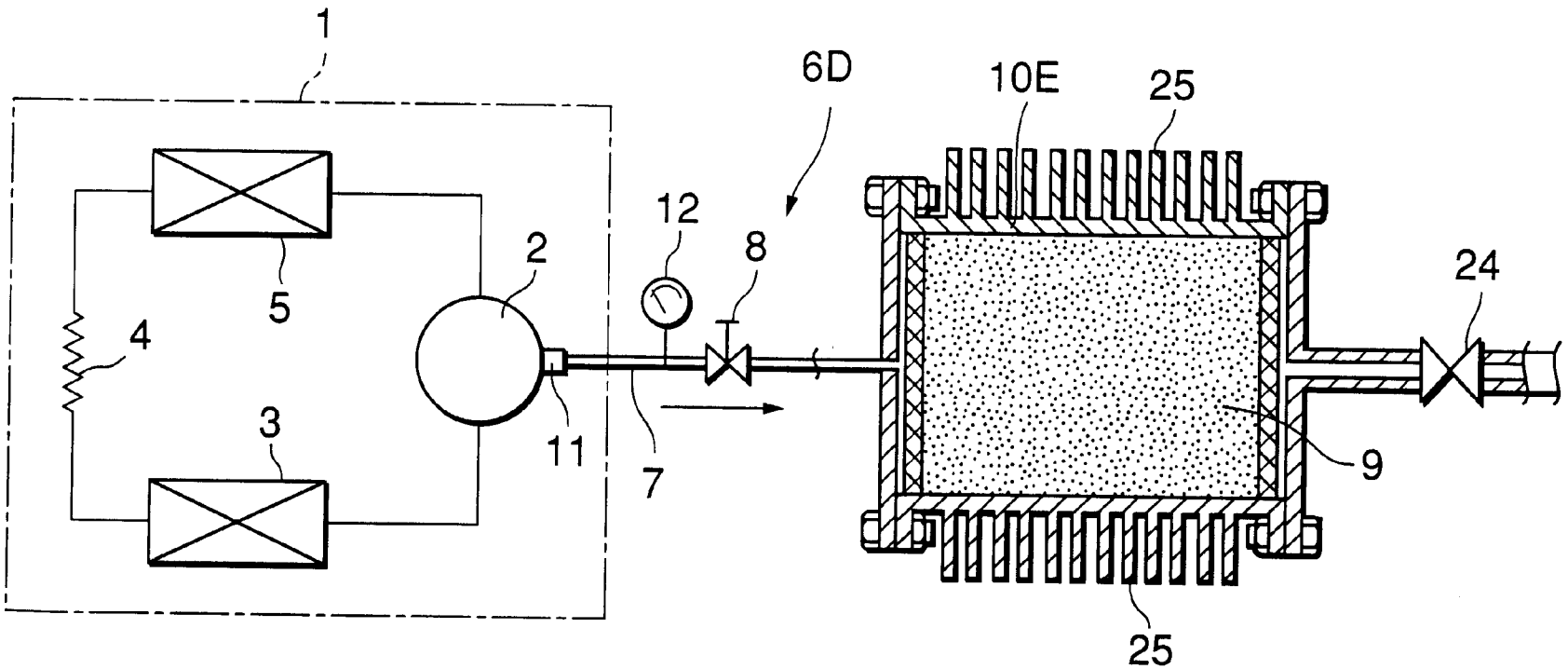
FIG. 5 is an explanatory view showing that another refrigerant recovery apparatus of the present invention is connected to the refrigerant circuit of the refrigerator shown in FIG. 1.

Here, when the refrigerants are adsorbed to the solid adsorbent 9, heat is generated. In this case, as shown in FIG. 5, the refrigerant recovery main body (10E in this case) can preferably be air-cooled. In this case, the refrigerant recovery main body 110E is constituted in the same manner as the refrigerant recovery main body 10D shown in FIG. 4 except that a large number of thin fins (formed of aluminum, aluminum alloy, and the like) 25 are arranged substantially in parallel with the outer periphery at substantially constant intervals.

In the case in which the refrigerants in the refrigerant circuit (e.g., the Freon refrigerants, hydrocarbons, helium, ammonia, air, and the like) need to be recovered because the refrigerator 1 has been used up and for other reasons, the opening/closing valve 24 remains to be closed, the opening/closing valve 8 is opened, then the refrigerants flow in the direction shown by the arrow and are adsorbed to the solid adsorbent 9 without using the suction pump or the like, and heat is generated. However, by using an air fan usually used for air cooling to efficiently cool the refrigerant recovery main body 10E provided with the fins 25, substantially all the refrigerants in the refrigerant circuit can efficiently be recovered into the refrigerant recovery main body 10E.

Figure 6:
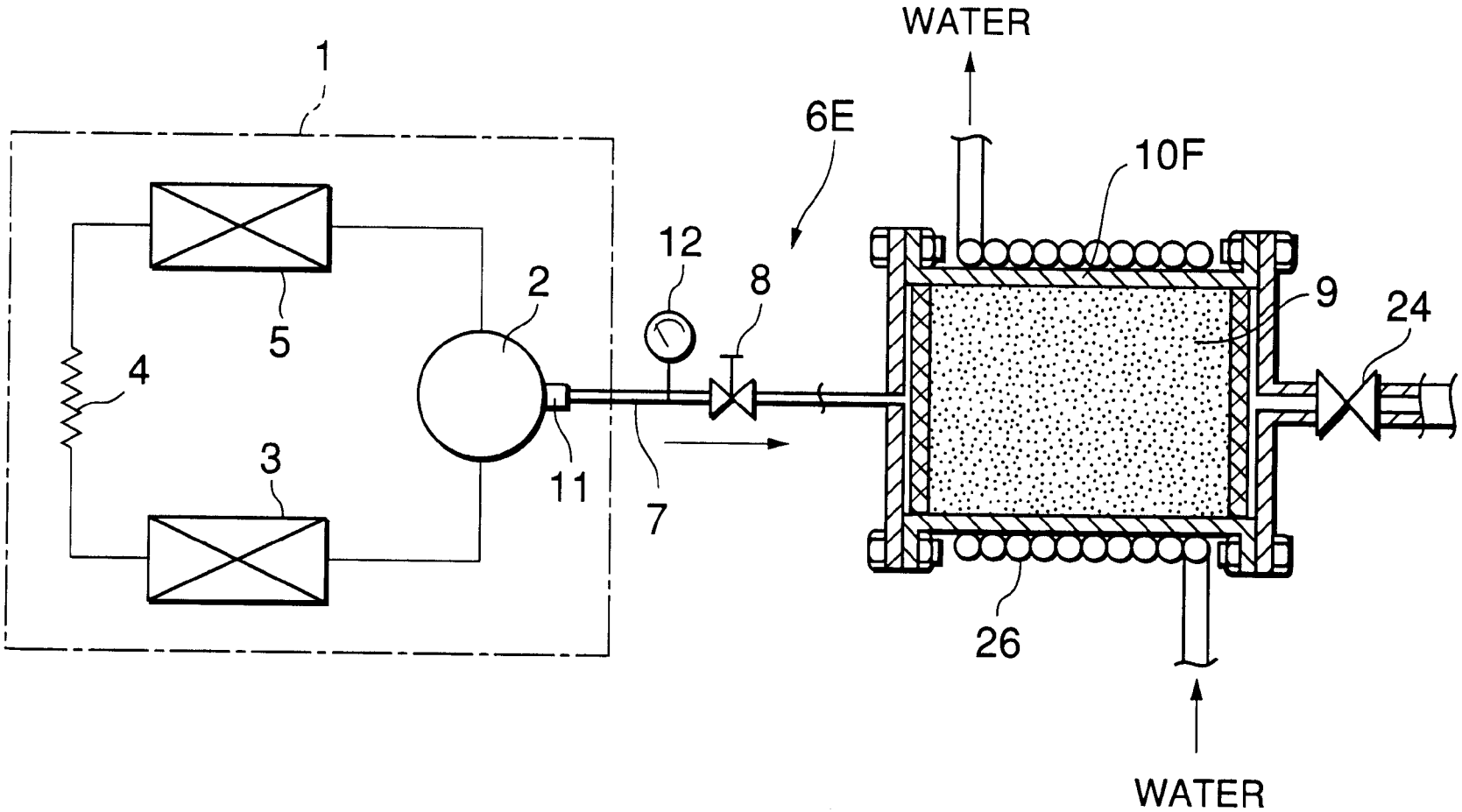
FIG. 6 is an explanatory view showing that another refrigerant recovery apparatus of the present invention is connected to the refrigerant circuit of the refrigerator shown in FIG. 1.

On the other hand, as shown in FIG. 6, the refrigerant recovery main body (10F in this case) maybe water-cooled. This refrigerant recovery main body 10F is constituted similarly to the refrigerant recovery main body 10D shown in FIG. 4 except that a cooling pipe 26 is wound around the outer periphery.

In the case in which the refrigerants in the refrigerant circuit need to be recovered because the refrigerator 1 has been used up and for other reasons, the opening/closing valve 24 remains to be closed, the opening/closing valve 8 is opened, then the refrigerants flow in the direction shown by the arrow and are adsorbed to the solid adsorbent 9 without using the suction pump, and heat is generated, but by passing cooling water in the cooling pipe 26 as shown by an arrow, the refrigerant recovery main body F can efficiently be cooled, so that substantially all the refrigerants in the refrigerant circuit can be recovered into the refrigerant recovery main body 10F.

Additionally, to water-cool the refrigerant recovery main body 10D shown in FIG. 4, the whole or a part of the refrigerant recovery main body 10D may be immersed in a cooling water tank during the adsorbing/recovering of the refrigerants to the solid adsorbent 9. Furthermore, cooling can also be performed by combining the above-described air-cooling and water-cooling.

Figure 7:
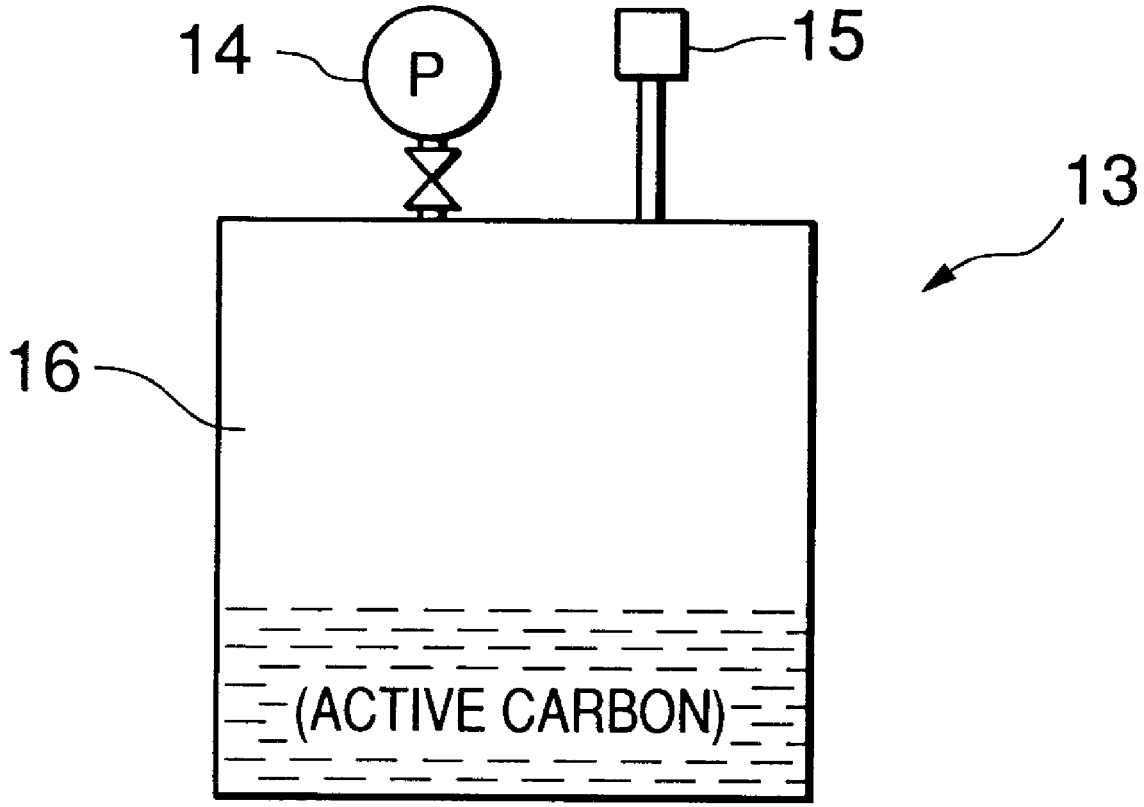
FIG. 7 is a sectional explanatory view showing an experiment apparatus for testing the refrigerant adsorption performance of an active carbon.

FIG. 7 is a sectional explanatory view showing an experiment apparatus for testing the refrigerant adsorption performance of the active carbon. This experiment apparatus 13 is constituted of a sealed container 16 provided with a pressure gauge 14 and an active carbon outlet/inlet port 15 so that the internal volume can be changed in the range of about 100 ml to 1000 ml.

In normal temperatures the refrigerant and the active carbon were placed into the sealed container 16 at a predetermined weight ratio (active carbon/refrigerant =0.75, 1, 2 and 3), and the refrigerant adsorption performance of the active carbon was tested. Refrigerant R134a was used.

Figure 8:
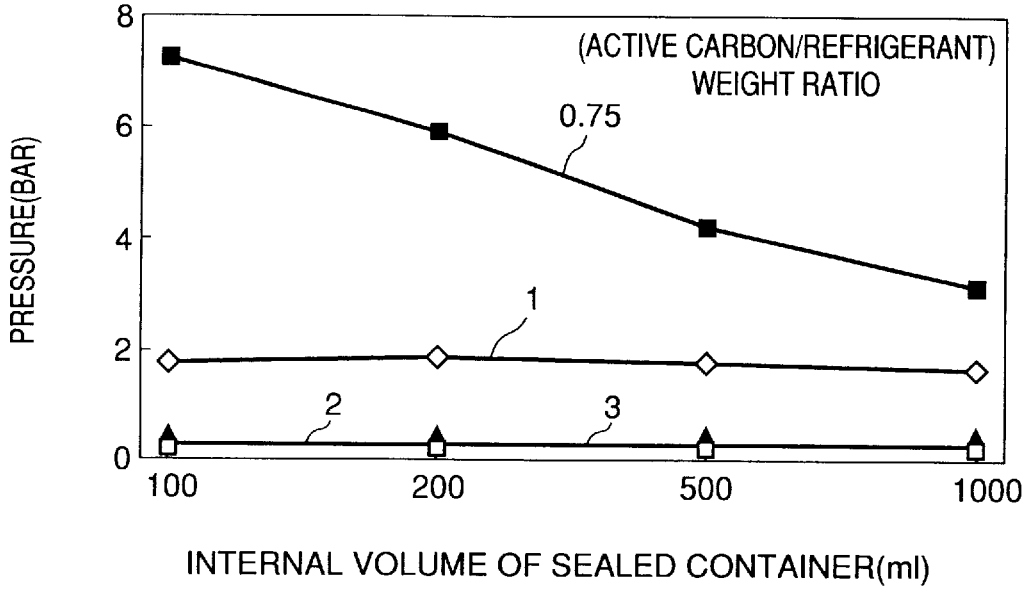
FIG. 8 is a graph showing the pressure (bar) of a gas phase portion in a sealed container in an axis of ordinate when the internal volume of the sealed container is changed in the range of about 100 ml to 1000 ml (axis of abscissa), and an (active carbon/refrigerant) weight ratio is changed to 0.75, 1, 2 and 3.

FIG. 8 is a graph showing the pressure (bar) of a gas phase portion in the sealed container 16 in the axis of ordinate when the internal volume of the sealed container 16 was changed in the range of about 100 ml to 1000 ml (axis of abscissa), and the (active carbon/refrigerant) weight ratio was changed to 0.75, 1, 2 and 3. The influence of the refrigerant circuit volume onto the internal pressure was tested.

Figure 9:
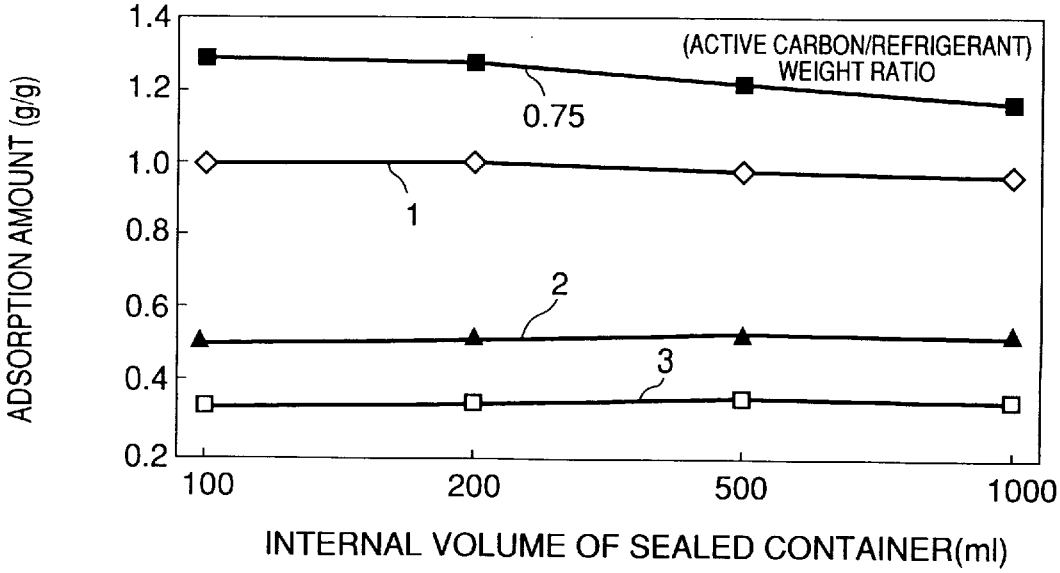
FIG. 9 is a graph showing the adsorption amount g/g of the active carbon (axis of ordinate) when the internal volume of the sealed container is changed in the range of about 100 ml to 1000 ml (axis of abscissa), and the (active carbon/refrigerant) weight ratio is changed to 0.75, 1, 2 and 3.

FIG. 9 is a graph showing the adsorption amount g/g of the active carbon (axis of ordinate) when the internal volume of the sealed container 16 was changed in the range of about 100 ml to 1000 ml (axis of abscissa), and the (active carbon/refrigerant) weight ratio was changed to 0.75, 1, 2 and 3. When the (active carbon/refrigerant) weight ratio is 0.75, and when the internal volume of the sealed container 16 increases, the adsorption amount of the active carbon decreases.

Figure 10:
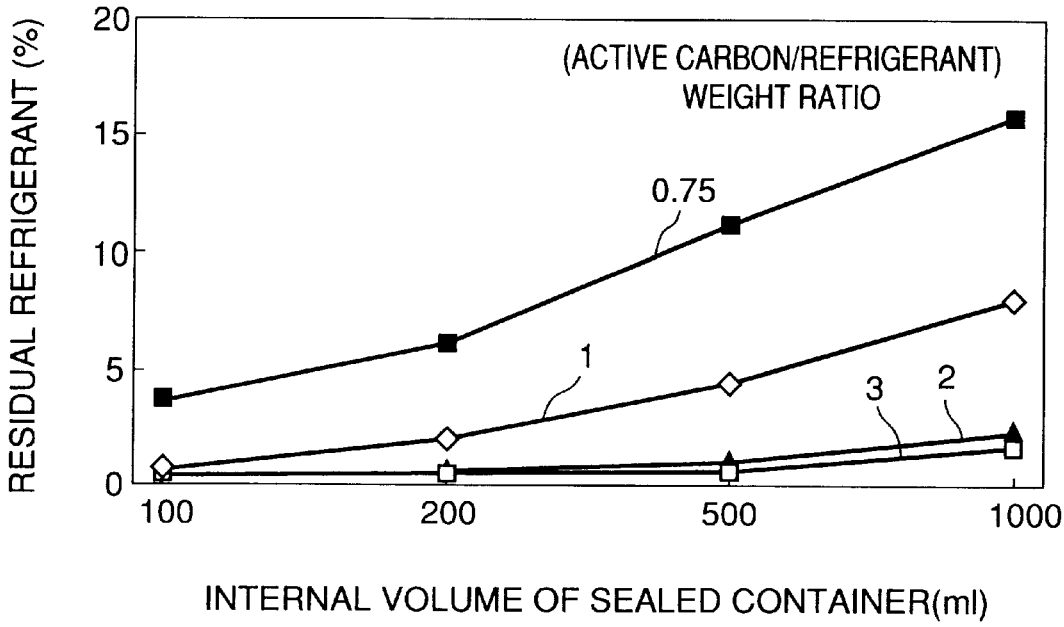
FIG. 10 is a graph showing the proportion % of residual refrigerants not adsorbed in the gas phase portion of the sealed container (axis of ordinate), when the internal volume of the sealed container is changed in the range of about 100 ml to 1000 ml (axis of abscissa), and the (active carbon/refrigerant) weight ratio is changed to 0.75, 1, 2 and 3.

FIG. 10 is a graph showing the proportion % of residual refrigerants not adsorbed in the gas phase portion of the sealed container 16 (axis of ordinate), when the internal volume of the sealed container 16 was changed in the range of about 100 ml to 1000 ml (axis of abscissa), and the (active carbon/refrigerant) weight ratio was changed to 0.75, 1, 2 and 3. When the internal volume of the sealed container 16 increases, the residual amount increases.

Figure 11:
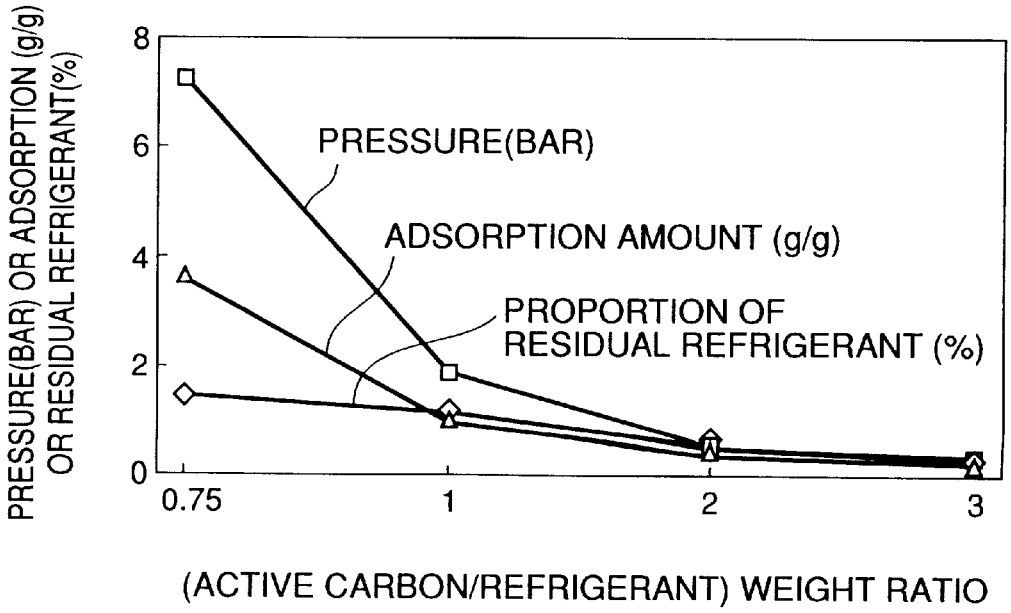
FIG. 11 is a graph showing the pressure (bar) of the gas phase portion in the sealed container, the adsorption amount g/g of the active carbon, and the proportion % of residual refrigerants not adsorbed in the gas phase portion of the sealed container in the axis of ordinate, respectively, when the internal volume of the sealed container is set to 100 ml, and the (active carbon/refrigerant) weight ratio is changed to 0.75, 1, 2 and 3 (axis of abscissa).

FIG. 11 is a graph showing the pressure (bar) of the gas phase portion in the sealed container 16, the adsorption amount g/g of the active carbon, and the proportion % of residual refrigerants not adsorbed in the gas phase portion of the sealed container 16 in the axis of ordinate, respectively, when the internal volume of the sealed container 16 was set to 100 ml, and the (active carbon/refrigerant) weight ratio was changed to 0.75, 1, 2 and 3 (axis of abscissa).

It can be seen from FIGS. 8 to 11 that the refrigerant 134a can efficiently be adsorbed to the active carbon at the (active carbon/refrigerant) weight ratio of 1 or more.

Figure 12:
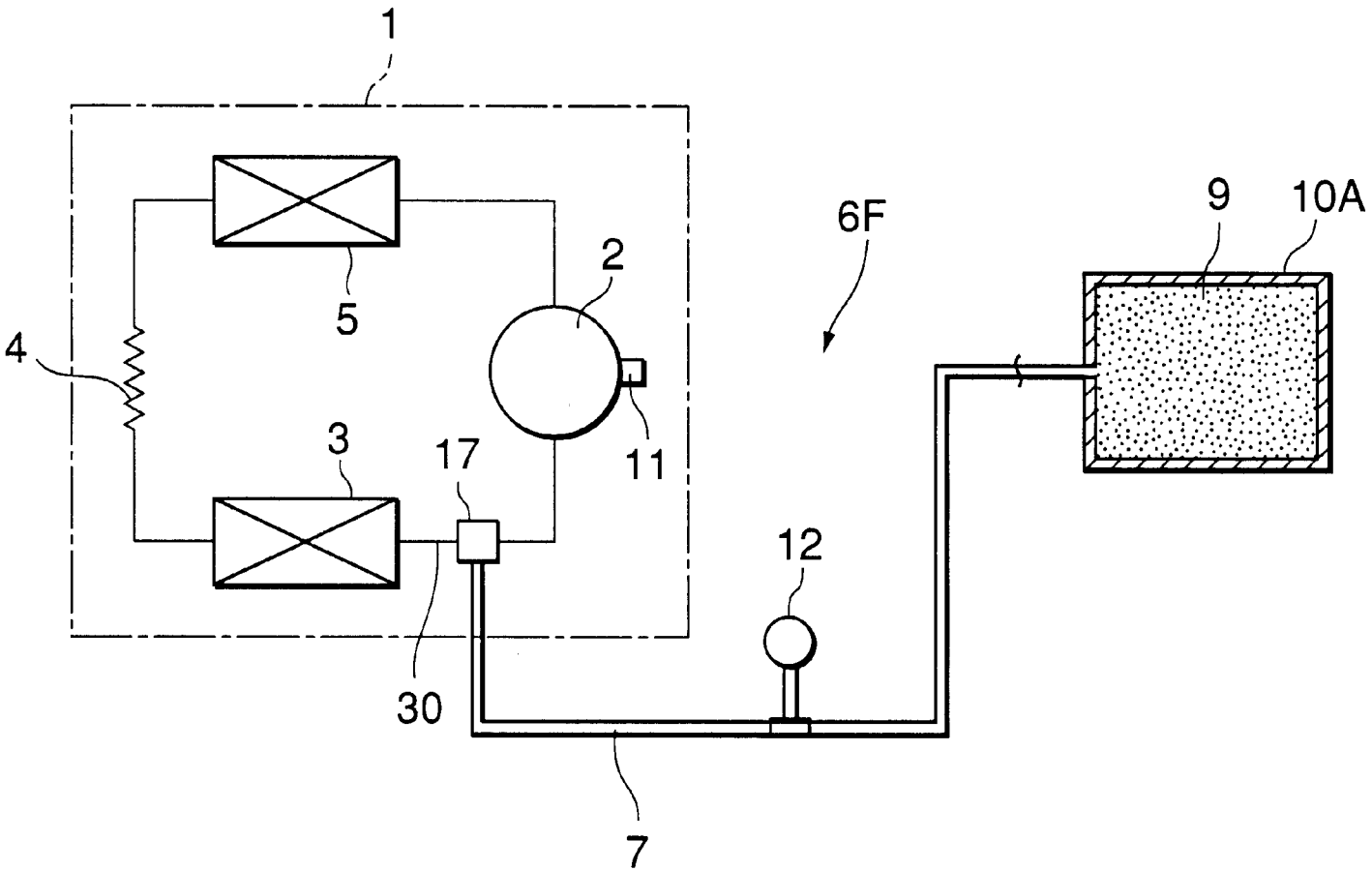
FIG. 12 is an explanatory view showing that another refrigerant recovery apparatus of the present invention is connected to the refrigerant circuit of the refrigerator, FIG. 13(*a*) is an explanatory view showing a tube passing valve as one concrete example of a valve provided with a clamping/piercing function shown in FIG. 12, FIG. 13(*b*) is a sectional explanatory view showing that the tube passing valve is attached to a pipeline.

Subsequently, FIG. 12 is an explanatory view showing that another refrigerant recovery apparatus of the present invention is connected to the refrigerant circuit of the refrigerator.

In FIG. 12, another refrigerant recovery apparatus 6F of the present invention is constituted of the pipeline 7 for connection to the refrigerant circuit, a clamping/piercing function valve 17 disposed on the tip end of the pipeline 7, and the refrigerant recovery main body 110A containing the solid adsorbent 9 which can adsorb the refrigerants, and the clamping/piercing function valve 17 is attached to an appropriate pipeline 30 of the refrigerant circuit for connecting the compressor 2 and the condenser 3. Numeral 12 denotes a pressure gauge.

Figure 13A:
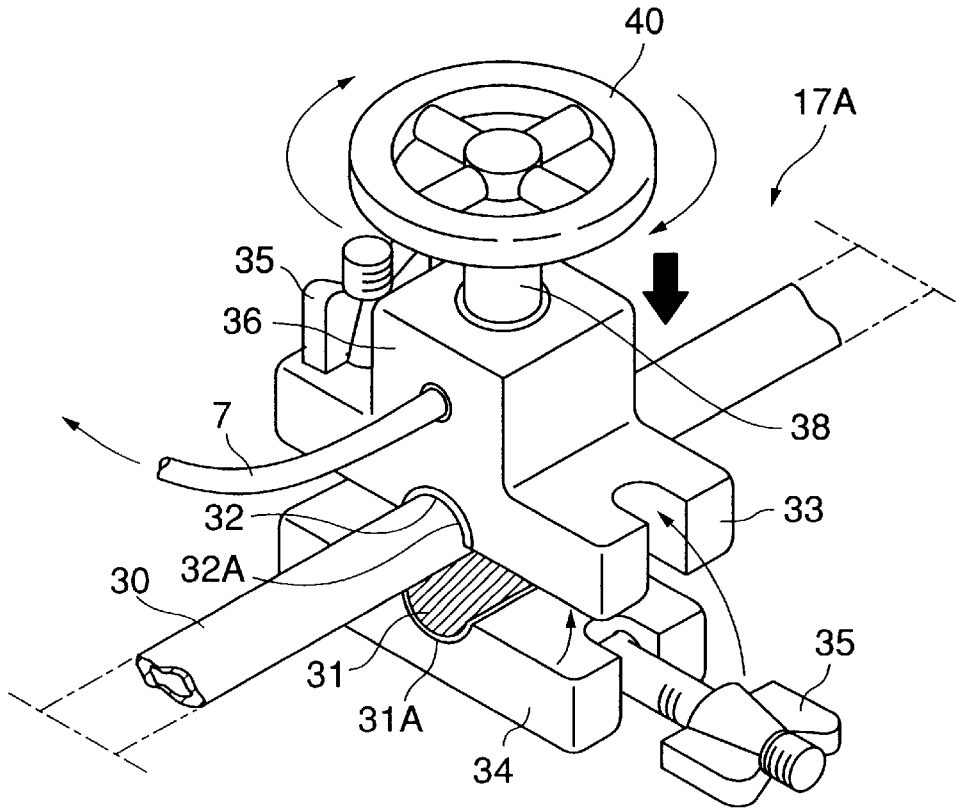
Figure 13B:
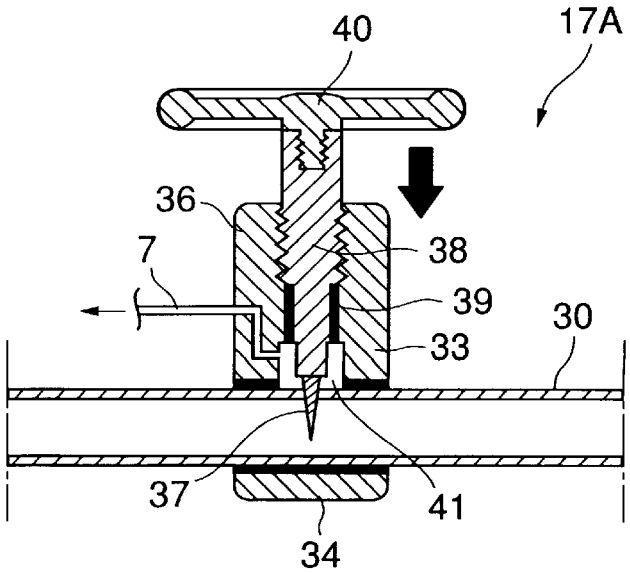

FIG. 13(*a*) is an explanatory view showing a tube passing valve 17A as one concrete example of the valve 17 provided with the clamping/piercing function shown in FIG. 12, and FIG. 13(*b*) is a sectional explanatory view showing that the tube passing valve 17A is attached to the pipeline 30.

The tube passing valve 17A is constituted of a lower portion 34 provided with a semicircular fixing portion 31 and an upper portion 33 provided with a semicircular fixing portion 32 to hold from above and below and firmly fix the pipeline 30, and the surfaces of the semicircular fixing portions 31 and 32 are lined with rubber packings 31A, 32A, respectively. Both end portions of the upper portion 33 and the lower portion 34 are provided with butterfly screws 35, so that after holding the pipeline 30 between the semicircular fixing portions 31 and 32, the butterfly screws 35 are tightened to firmly hold the pipeline 30.

A convex portion 36 extended upward is integrally formed on the top surface of the upper section 33, and a valve shaft 38 having a needle 37 for making a small hole in the pipeline 30 on its tip end is attached in a hermetic state in a bearing 39 of this convex portion 36. Numeral 40 denotes a handle for screwing downward or moving upward the valve shaft 38.

By setting the inner diameter of the lower portion of the bearing 39 to be larger than the outer diameter of the lower portion of the valve shaft 38, a void 41 is formed between the lower portion of the bearing 39 and the lower portion of the valve shaft 38. Furthermore, by connecting the pipeline 7 of the refrigerant recovery main body 110A to one side face of the convex portion 36, the void 41 is connected.

In the case in which the refrigerants in the refrigerant circuit need to be recovered because the refrigerator 1 has been used up and for other reasons, the tube passing valve 17A is used to hold the pipeline 30 between the semicircular fixing portions 31 and 32, the butterfly screws 35 are tightened to firmly fix the pipeline 30, then the handle 40 is turned to move the valve shaft 38 downward and operate the needle 37 attached to the tip end of the shaft so that the tip end of the needle breaks the pipe wall of the pipeline 30 and makes a small hole.

At this time the refrigerants have not come out of the small hole, but when the handle 40 is turned in reverse to slightly move the valve shaft 38 upward, a gap is made between the small hole and the needle 37, and the refrigerants flow out of the pipeline 30 via this gap and flow into the pipeline 7 via the gap 41, so that the refrigerants having entered the pipeline 7 flow in the direction shown by an arrow and are adsorbed to the solid adsorbent 9 without using the suction pump.

Figure 14:
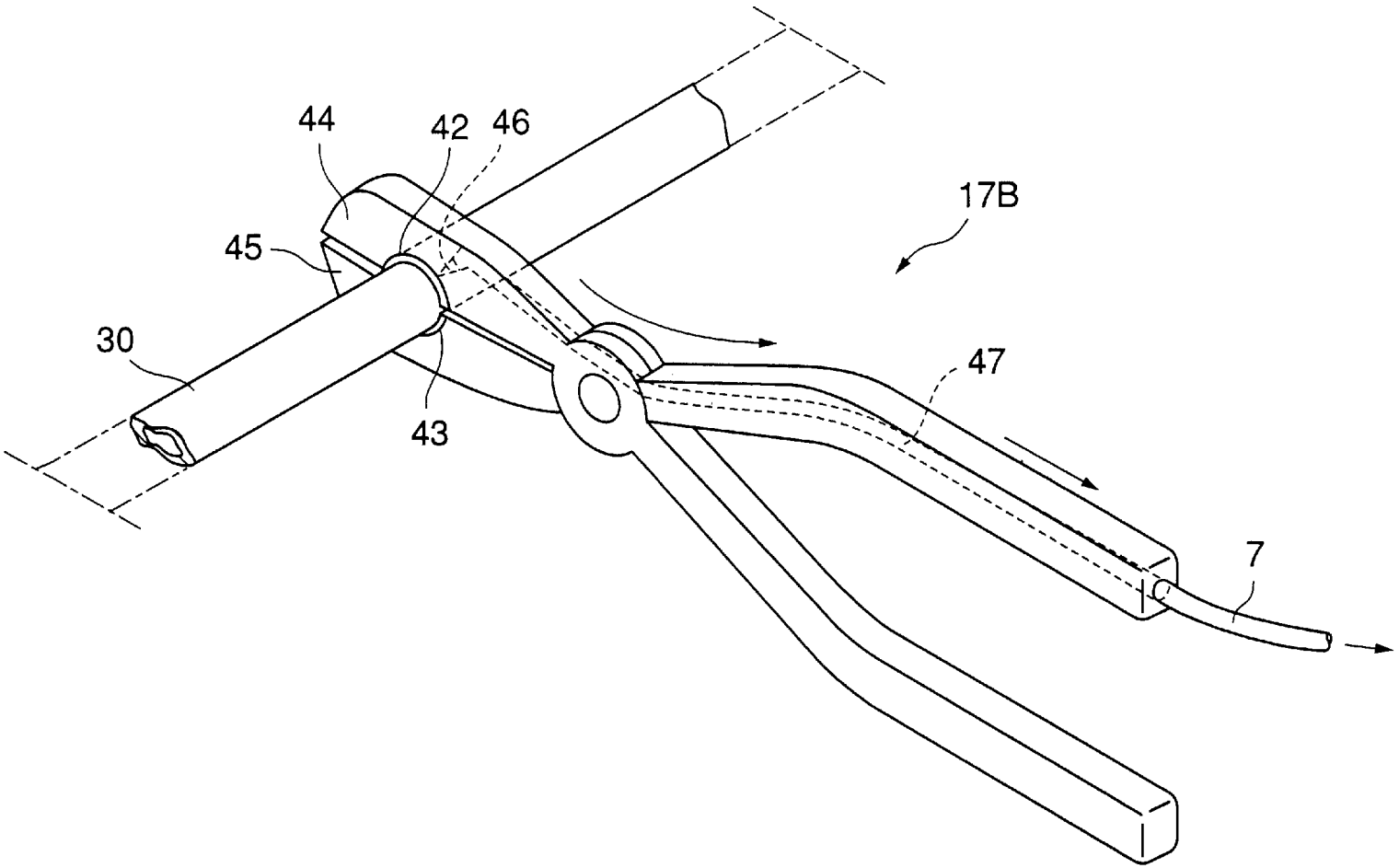
FIG. 14 is an explanatory view showing a pierce/pinch tube passing valve as another example of the valve provided with the clamping/piercing function shown in FIG. 12.

FIG. 14 is an explanatory view showing a pierce/pinch tube passing valve 17B as another example of the valve 17 provided with the clamping/piercing function shown in FIG. 12.

The tip end of the pierce/pinch tube passing valve 17B is constituted of an upper portion 44 provided with a semicircular fixing portion 42 and a lower portion 45 provided with a semicircular fixing portion 43 to hold the pipeline 30 from above and below and firmly fix the pipeline 30, and the surfaces of the semicircular fixing portions 42 and 43 are lined with the rubber packings, respectively. The upper portion 44 and the lower portion 45 are provided with handles, so that the pipeline 30 is held between the semicircular fixing portions 42 and 43 and the pipeline 30 is firmly fixed.

A needle 46 for making a small hole in the pipeline 30 is attached to the semicircular fixing portion 42 of the upper portion 44. A passage 47 for guiding the refrigerants out of the small hole to the outside is disposed through the needle 46, the upper portion 44 and the associated inside of the handle, and its outlet is connected to the pipeline 7.

In the case in which the refrigerants in the refrigerant circuit need to be recovered because the refrigerator 1 has been used up and for other reasons, the pierce/pinch tube passing valve 17B is used to hold the pipeline 30 between the semicircular fixing portions 42 and 43 and the handle is tightened to firmly hold the pipeline 30, so that the tip end of the needle 46 is operated to break the pipe wall and make the small hole.

At this time the refrigerants have not come out of the small hole, but when the handle is operated in reverse to slightly move the needle 46 upward, a gap is made between the small hole and the needle 46, and the refrigerants flow out of the pipeline 30 via this gap and flow into the pipeline 7 via the passage 47, so that the refrigerants having entered the pipeline 7 flow in the direction shown by an arrow and are adsorbed to the solid adsorbent 9 without using the suction pump.

The valve provided with the clamping/piercing function shown in FIGS. 13 and 14 is on the market, and in the present invention, the market valves with appropriate sizes can be used, for example, in accordance with a pipe diameter of ½ inch or ⅜ inch of the pipeline 30. As a concrete example of the market clamping/piercing function valve, the valve manufactured by Fuji Koki Co., Ltd. is exemplified in Japan, as a concrete example of the tube passing valve, model Nos. EAp401A and EA401A manufactured by ROBINAIR Co., Ltd., and as a concrete example of the pierce/pinch tube passing valve, model No.14210 standard manufactured by REFCO Co., Ltd., and the like can be exemplified. When the tube passing valve 17A or the pierce/pinch tube passing valve 17B is used, the opening/closing valve 8 shown in FIGS. 1 to 6 becomes unnecessary, thereby further simplifying the structure of the refrigerant recovery apparatus.

Figure 15:
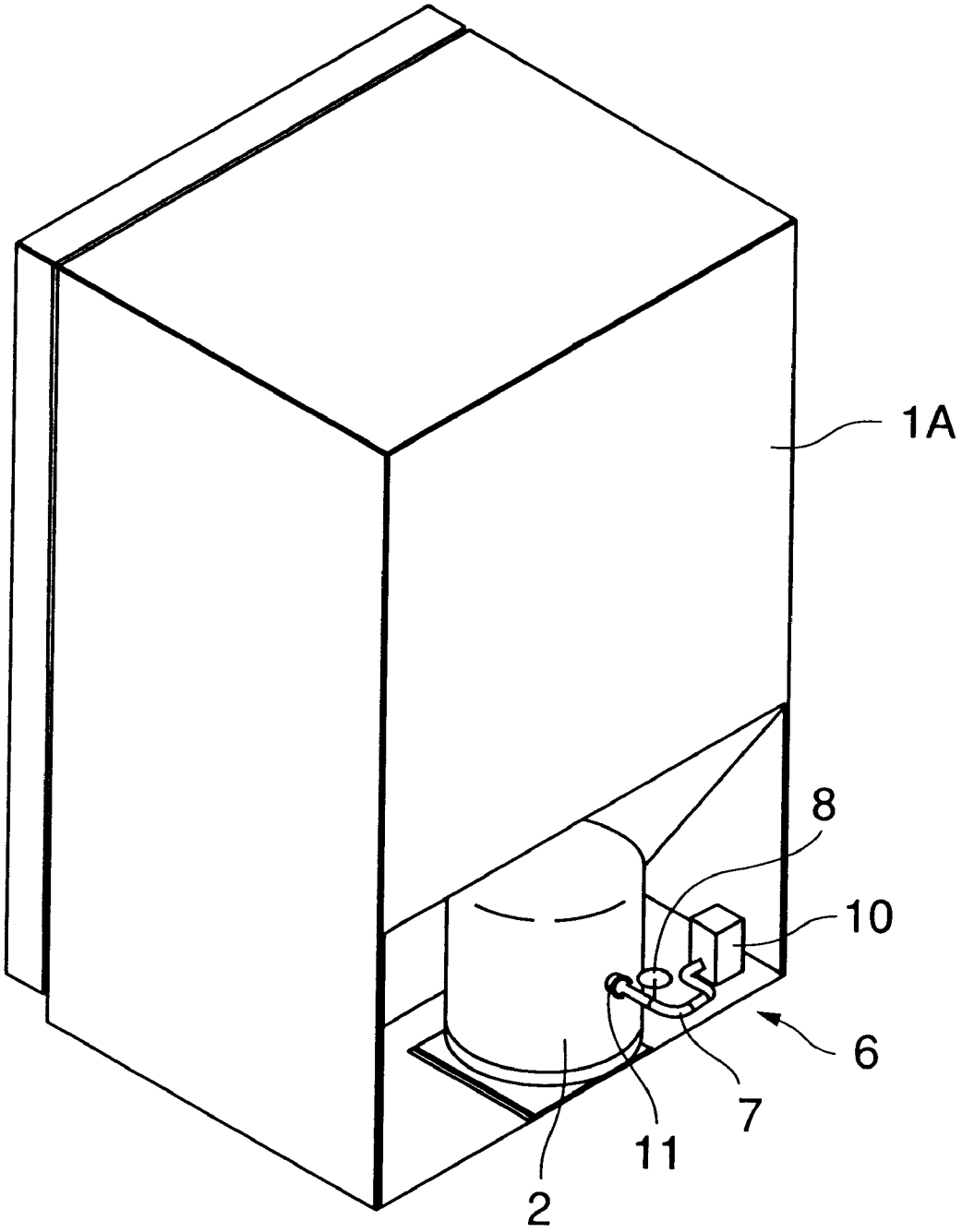
FIG. 15 is an explanatory view showing the embodiment of a refrigerator as the refrigeration apparatus provided with the refrigerant recovery apparatus of the present invention.

FIG. 15 is an explanatory view showing the embodiment of the refrigeration apparatus provided with the refrigerant recovery apparatus of the present invention.

Numeral 1A denotes a refrigerator with the compressor 2 mounted thereon, and the refrigerant recovery apparatus 6 of the present invention is connected to the tip end of the seal pipe 11 for sealing the refrigerant to the compressor 2 of this refrigerator 1A. The refrigerant recovery apparatus 6 is constituted of the pipeline 7 for connection to the refrigerant circuit, the opening/closing valve 8 disposed on the pipeline 7, the refrigerant recovery main body 10 containing the solid adsorbent 9 (not shown) which can adsorb the refrigerant in the refrigerant circuit.

Since this refrigerator 1A is connected to the refrigerant recovery apparatus 6 beforehand, even in the case in which the refrigerants in the refrigerant circuit need to be recovered because the refrigerator 1A has been used and for other reasons, the refrigerant recovery apparatus of the present invention does not have to be carried, and by opening the opening/closing valve 8 installed beforehand, the refrigerants are adsorbed to the solid adsorbent 9 (not shown) without using the suction pump as described above, so that substantially all the refrigerants in the refrigerant circuit can effectively be recovered into the refrigerant recovery main body 10. Subsequently, when the refrigerant recovery main body 10 is removed and recovered, the recovery of the refrigerants of the refrigerator 1A is completed.

In this case, if the opening/closing valve 8 is opened by mistake, the refrigerants are all adsorbed/recovered by the solid adsorbent 9 (not shown). Therefore, in order to prevent the operation error, it is preferable to provide the opening/closing valve 8 with a stopper so that the valve cannot be opened until the stopper is released, to attach a tag with instructions described thereon to the opening/closing valve 8, or to provide the valve with a fail-safe or foolproof mechanism so that the opening/closing valve 8 is prevented from being opened/closed by human errors, mechanical or electrical errors, and the like.

Figure 16:
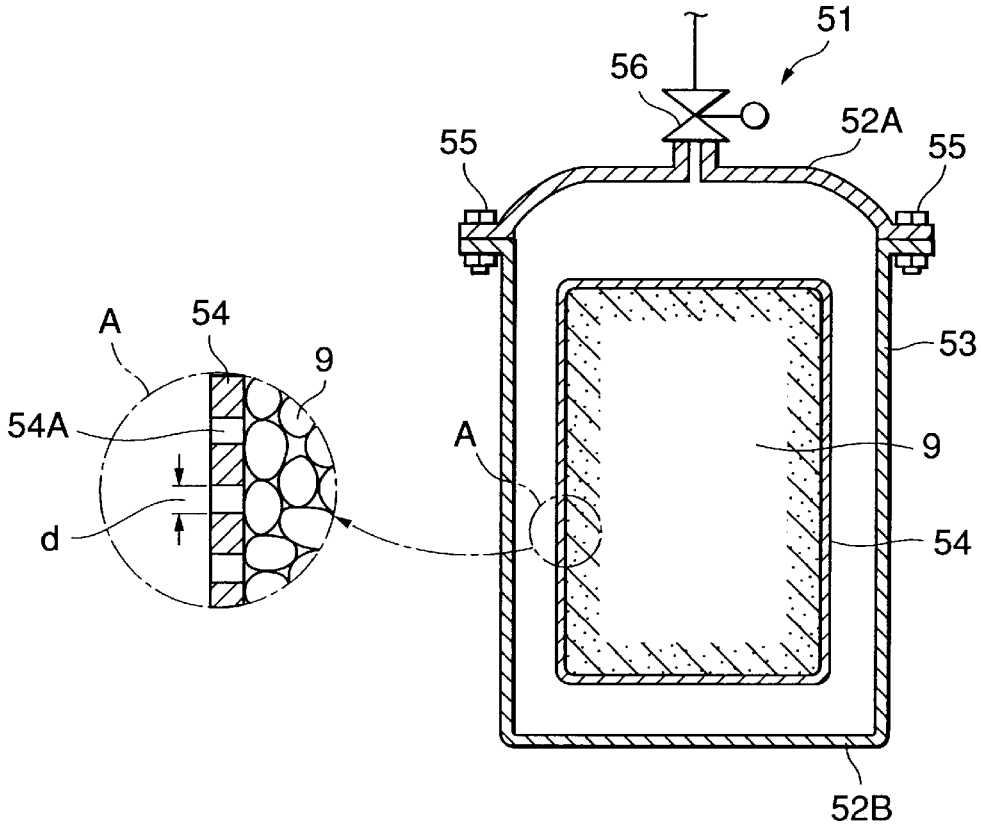
FIG. 16 is an explanatory view showing another refrigerant recovery apparatus of the present invention.

FIG. 16 is an explanatory view showing one embodiment of another refrigerant recovery apparatus of the present invention.

In FIG. 16, a refrigerant recovery apparatus 51 of the present invention is a vertical type example, and is provided with a refrigerant recovery main body 53 containing the solid adsorbent 9 (e.g., particulate active carbon) which can adsorb the refrigerants in a container 52. This solid adsorbent 9 is wrapped and held in an air-permeable non-woven bag 54. A part of the air-permeable non-woven bag 54, and the like is enlarged and shown in circle A of FIG. 16. An opening d of a hole 54A of the air-permeable non-woven bag 54 is sized to transmit air, refrigerants, and the like but prevent the solid adsorbent 9 from leaking to the outside. Therefore, the solid adsorbent 9 wrapped in the non-woven bag 54 does not leak to the outside of the non-woven bag 54, and the solid adsorbent 9 can be held inside the non-woven bag 54.

The container 52 is constituted of a top lid 52A and a main body 52B, and the lid 52A and the main body 52B can be sealed and connected with connectors 55. By attaching or detaching the connectors 55, the lid 52A can be opened/closed. When the lid 52A is opened, the non-woven bag 54 with the solid adsorbent 9 wrapped therein can be taken out of the container 52 for the purpose of changing or the like. Numeral 56 denotes a valve connected to the middle portion of the lid 52A.

Figure 17:
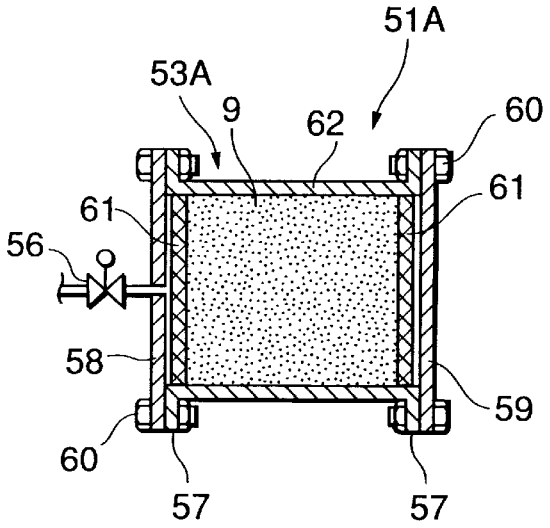
FIG. 17 is an explanatory view showing another refrigerant recovery apparatus of the present invention.

FIG. 17 is an explanatory view showing another refrigerant recovery apparatus of the present invention.

In FIG. 17, a refrigerant recovery apparatus 51A of the present invention is a horizontal type example, and is provided with a refrigerant recovery main body 53A containing the solid adsorbent 9 (e.g., particulate active carbon) which can adsorb the refrigerants in a container 62. The container 62 is provided with flange portions 57 on left and right end portions, and a flange portion 58 and another flange portion 59 are fixed with fixtures 60 such as a bolt. Numeral 61 denotes a filter, and 56 denotes a valve. The solid adsorbent 9 contained in the refrigerant recovery main body 53A is held by the filter 61 to prevent leakage to the outside.

The above-described air-permeable non-woven bag and filter prevent the solid adsorbent from leaking to the outside (refrigerant circuit), and may be a metal mesh in accordance with the particle size of the solid adsorbent. Moreover, these components are unnecessary when the solid adsorbent is solidified or blocked.

For the refrigerant recovery apparatus 51 or 51A of the present invention constituted as described above, the purpose of connection to the refrigerant circuit to recover the refrigerants has been illustrated and described, but the apparatus can also be connected to a bomb or a tank containing the refrigerants, and an apparatus for recovering foaming agents such as urethane foam (Freon, and the like used as the refrigerants are used as the foaming agents) to recover the refrigerants and the foaming agents.

Figure 18:
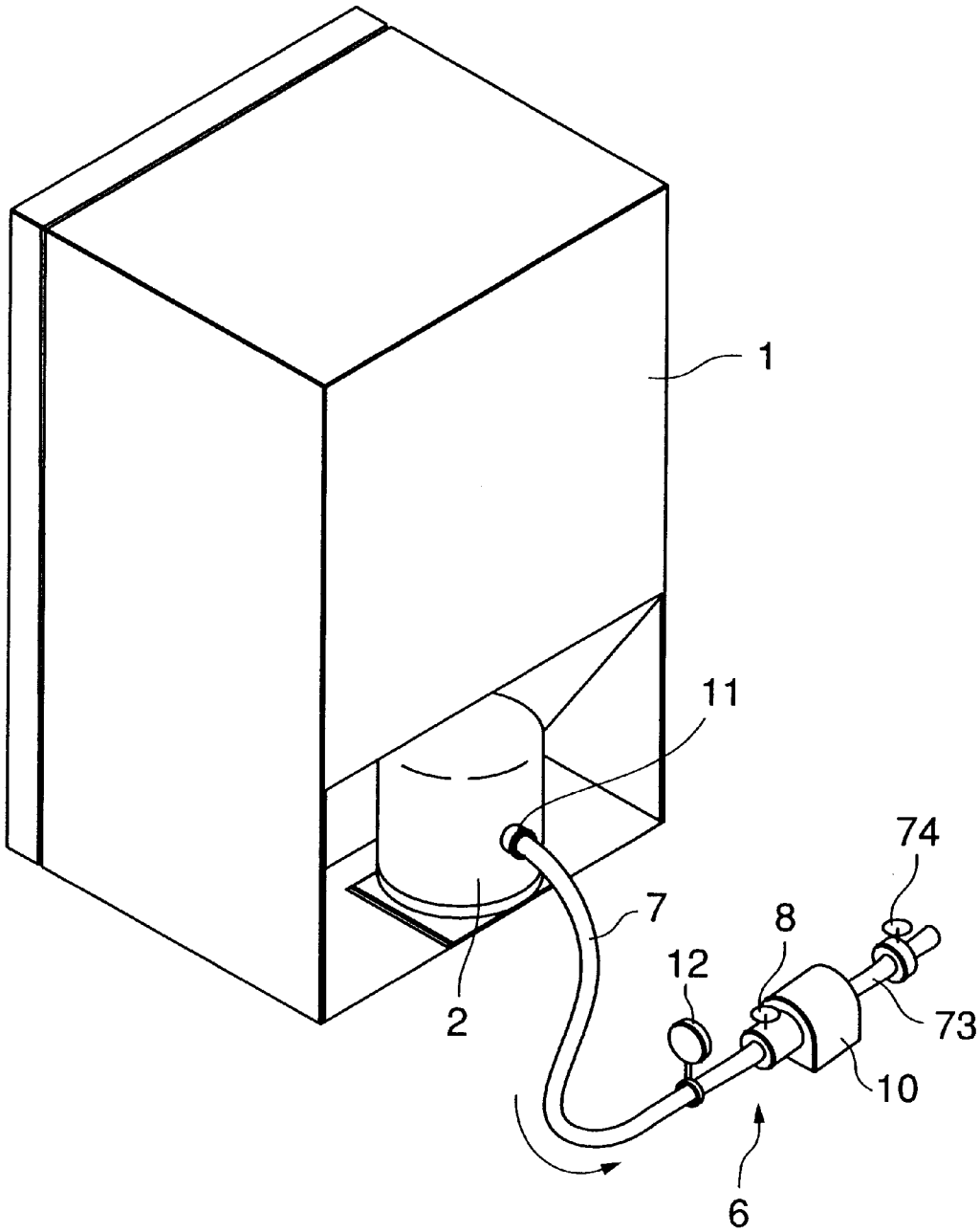
FIG. 18 is an explanatory view showing the embodiment of the refrigerator provided with another refrigerant recovery apparatus of the present invention.
Figure 19:
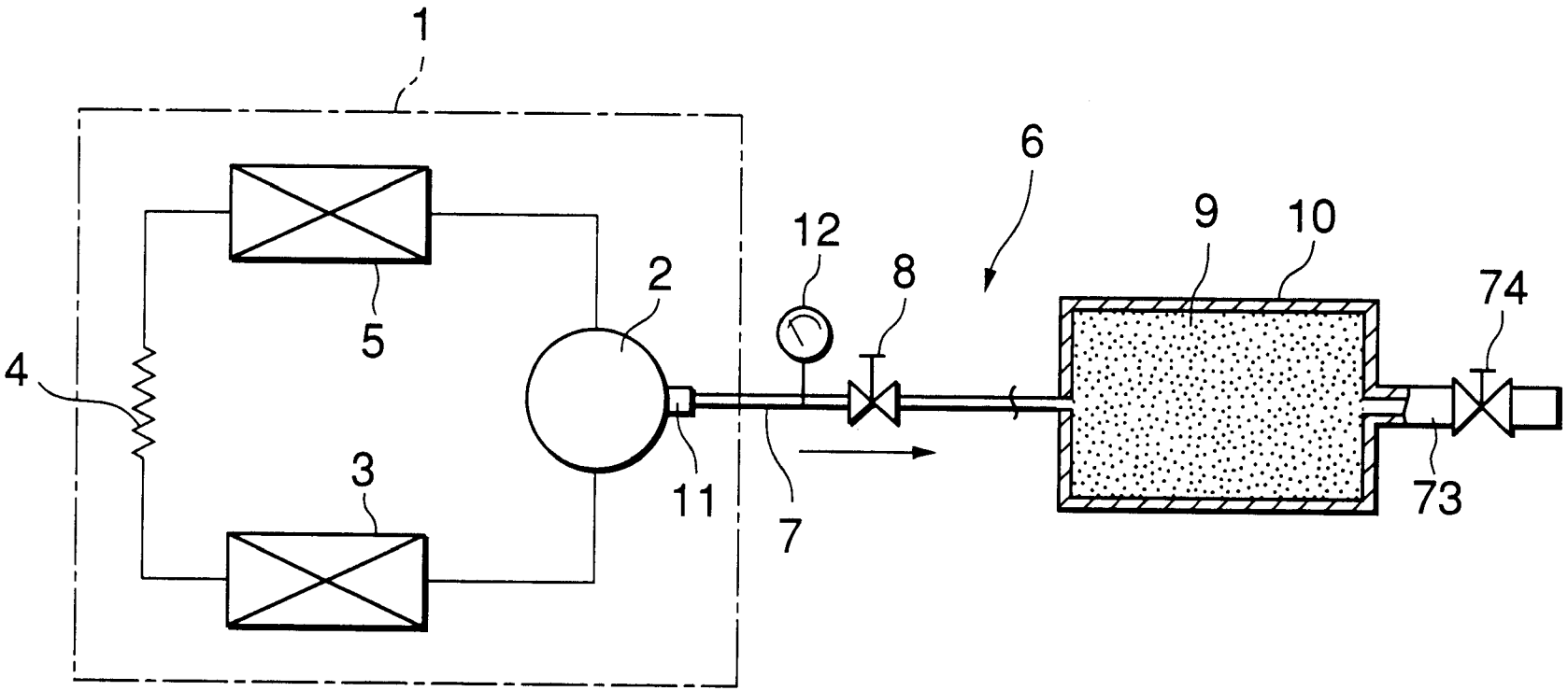
FIG. 19 is an explanatory view showing that the refrigerant recovery apparatus is connected to the refrigerant circuit of the refrigerator shown in FIG. 18.

Next, FIG. 18 is an explanatory view showing that another refrigerant recovery apparatus of the present invention is connected to the refrigerator, and FIG. 19 is an explanatory view showing that the refrigerant recovery apparatus is connected to the refrigerant circuit of the refrigerator shown in FIG. 18.

In FIGS. 18 and 19, numeral 1 denotes a refrigerator with the compressor 2 mounted thereon. The compressor 2 is successively connected to the condenser 3, the capillary tube 4 and the evaporator 5 to constitute the refrigerant circuit. The refrigerant recovery apparatus 6 is connected to the compressor 2 in this refrigerant circuit. The refrigerant recovery apparatus 6 is constituted of the pipeline 7 for connection to the refrigerant circuit, the opening/closing valve 8 disposed on the pipeline 7, the refrigerant recovery main body 10 containing the solid adsorbent 9 which can selectively adsorb the refrigerants in the refrigerant circuit, and the like.

One end of the pipeline 7 is connected to the tip end of the seal pipe 11 for sealing the refrigerants to the compressor 2 of the refrigerant circuit. Numeral 12 denotes a pressure gauge, 73 denotes a pipeline connected to the other end of the refrigerant recovery main body 10, and 74 denotes an opening/closing valve disposed on the pipeline 73.

This refrigerant recovery apparatus 6 is also simple in constitution, small in size and portable, can easily be conveyed and installed, and is easy to handle and operate.

In the above-described constitution, in the case in which the refrigerants in the refrigerant circuit (e.g., the Freon refrigerants, hydrocarbons, helium, ammonia, air, and the like) need to be recovered because the refrigerator 1 has been used and for other reasons, by opening the opening/closing valve 8 while the opening/closing valve 74 remains to be closed, the refrigerants flow in the direction shown by an arrow and are adsorbed to the solid adsorbent 9 without using any suction pump or the like, so that substantially all the refrigerants in the refrigerant circuit can be recovered into the refrigerant recovery main body 10.

Figure 20:
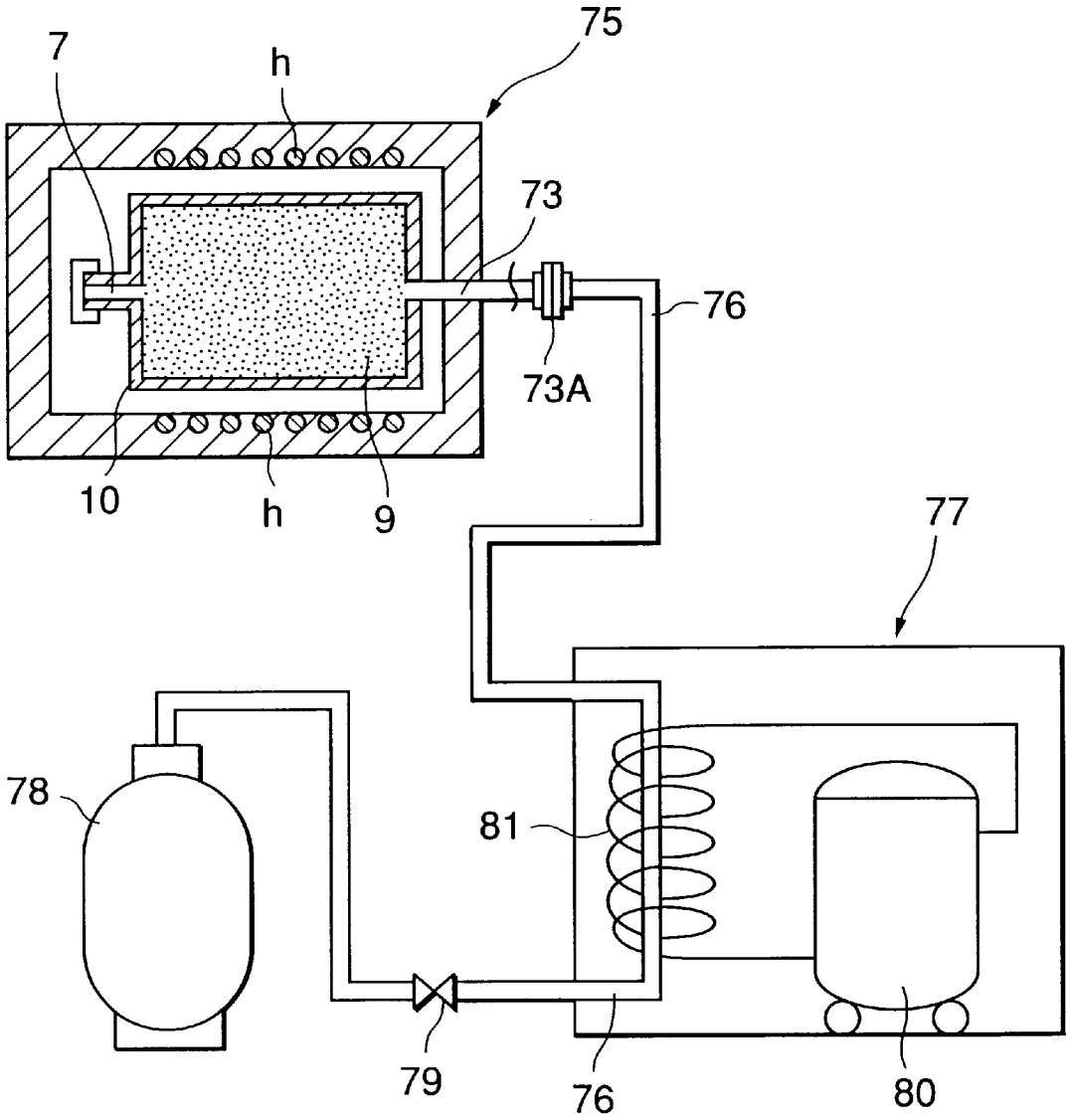
FIG. 20 is an explanatory view showing a recycling apparatus of the refrigerant recovery apparatus.

FIG. 20 is an explanatory view showing one embodiment of a recycling apparatus of this refrigerant recovery apparatus. In FIG. 20, numeral 75 denotes a heating apparatus provided with an electric heater h, in which the refrigerant recovery main body 10 containing the solid adsorbent 9 having adsorbed the refrigerants is placed. The end portion of the pipeline 7 of the refrigerant recovery main body 10 is closed, the pipeline 73 of the refrigerant recovery main body 10 is extended to the outside of the heating apparatus 75, and the end portion is connected to a pipeline 76 for discharging the desorbed refrigerants. Numeral 73A denotes a connector for connecting both pipelines.

A cooling apparatus 77 for cooling the desorbed refrigerants is disposed midway in the pipeline 76, and the end portion of the pipeline 76 passed through the cooling apparatus 77 is connected to a refrigerant container 78. Numeral 79 denotes an opening/closing valve. A refrigeration apparatus constituted of a compressor 80, a coiled evaporator 81, and the like is placed inside the cooling apparatus 77, and the coiled evaporator 81 is wound around the pipeline 76 in the cooling apparatus 77, so that the refrigerants in the pipeline 76 are cooled.

In the recycling apparatus of the refrigerant recovery apparatus 6 of the present invention constituted as described above, when the refrigerant recovery main body 10 containing the solid adsorbent 9 having adsorbed the refrigerants is heated, for example, to a temperature of 500° C. or more, the adsorbed refrigerants are desorbed and passed through the pipeline 73, enter the pipeline 76 in the cooling apparatus 77, and are cooled and liquefied. The liquefied refrigerants are recovered to the refrigerant container 78.

After the refrigerants are desorbed in this manner, the refrigerant recovery main body 10 containing the recycled solid adsorbent 9 is cooled, attached to the refrigerant recovery apparatus 6 and can be reused.

Naturally, after taking the solid adsorbent 9 having adsorbed the refrigerants out of the refrigerant recovery main body 10, placing the adsorbent into another sealed container (not shown), heating by the heating apparatus 75 or another heating means to desorb the refrigerants and recycling the solid adsorbent 9, the recycled solid adsorbent 9 is returned to the refrigerant recovery main body 10, and subsequently this refrigerant recovery main body 10 can be attached to the refrigerant recovery apparatus 6 and reused.

Figure 21:
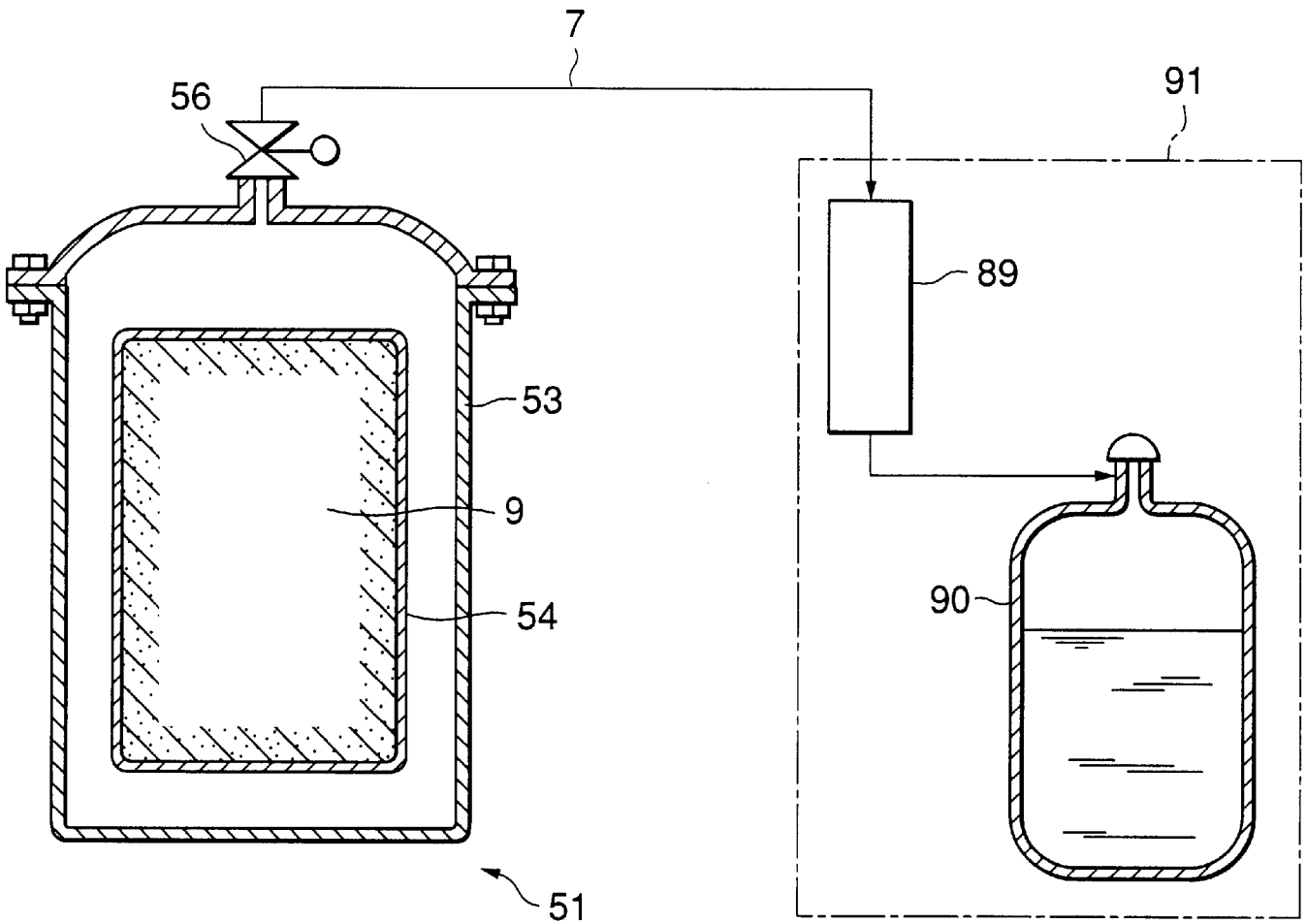
FIG. 21 is an explanatory view showing that the refrigerant recovery apparatus of the present invention having recovered the refrigerants is connected to a known refrigerant recovery machine.

Next, FIG. 21 is an explanatory view showing that the refrigerant recovery apparatus 51 of FIG. 16 having recovered the refrigerants is connected to a known refrigerant recovery machine. In this case, after the refrigerants in the refrigerant circuit are recovered into the sealed container 53 of the refrigerant recovery apparatus 51 (including the case of adsorbing or recovering otherwise the maximum refrigerant adsorption amount or more amount of refrigerants to the solid adsorbent 9 formed of particulate active carbon inside the sealed container 53, or the case of adsorbing and recovering the maximum refrigerant adsorption amount of or less refrigerants to the solid adsorbent 9), the refrigerant recovery apparatus 51 and the clamping/piercing function valve 17 are removed, one end of the pipeline 7 of the refrigerant recovery apparatus 51 is connected to a vacuum pump 89 of a known refrigerant recovery machine 91 provided with the vacuum pump 89, a bomb 90, and the like as shown in FIG. 21, the vacuum pump 89 is operated to suck the recovered refrigerants into the sealed container 53, and the refrigerants adsorbed to the solid adsorbent 9 are desorbed, liquefied, and placed into the bomb 90 for recovery.

In this case, the solid adsorbent 9 (particulate active carbon) of the refrigerant recovery apparatus 51 may directly or indirectly be heated by the heating means (not shown), thereby facilitating the desorption of the refrigerants.

After the refrigerants are recovered to the bomb 90 in this manner, the inside of the sealed container 53 of the refrigerant recovery apparatus 51 has a drawn vacuum state. Therefore, by maintaining the vacuum state, this refrigerant recovery apparatus 51 can easily be used for the next refrigerant recovery.

Figure 26:
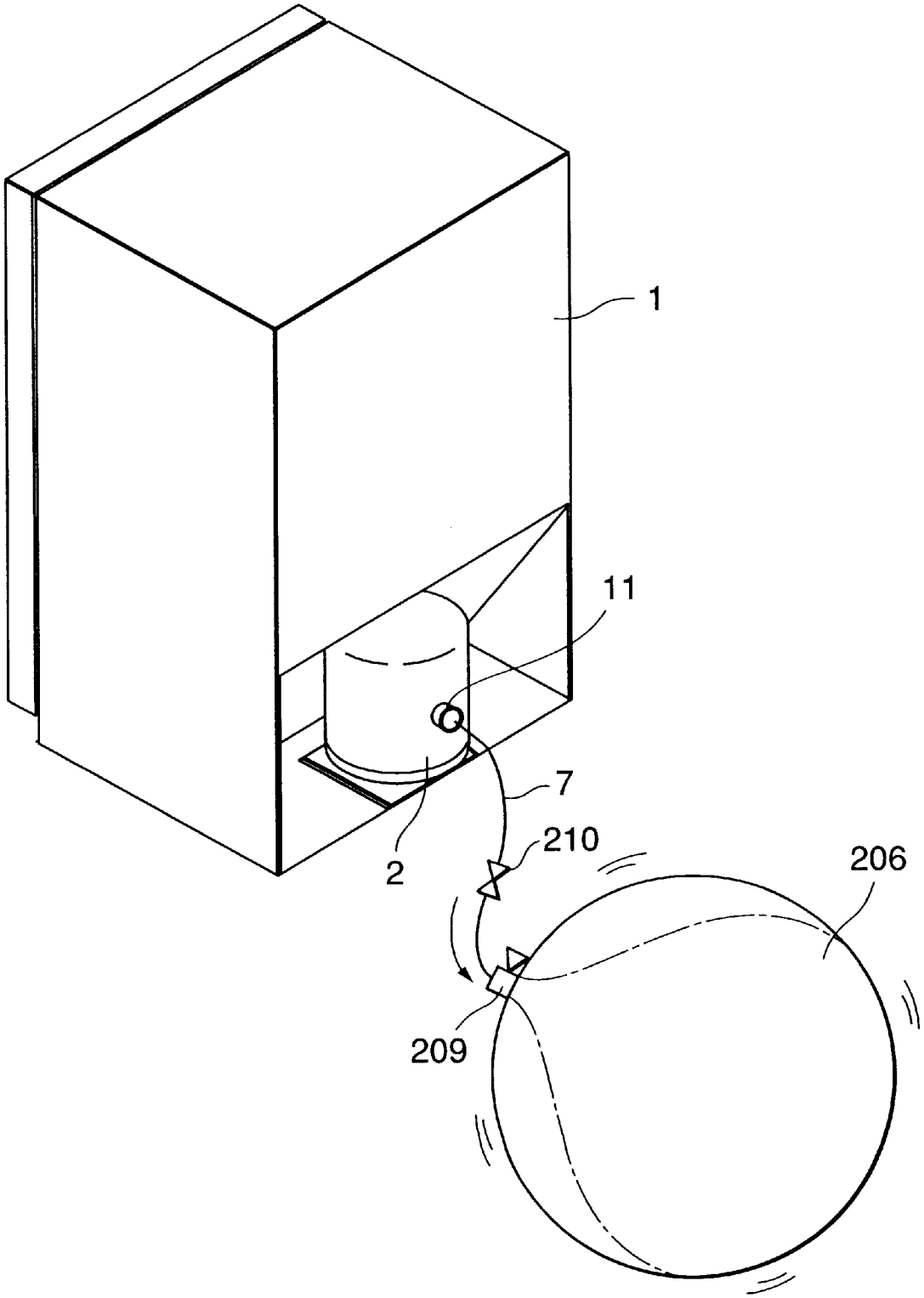
FIG. 26 is an explanatory view showing a conventional refrigerant recovery method.
Figure 27:
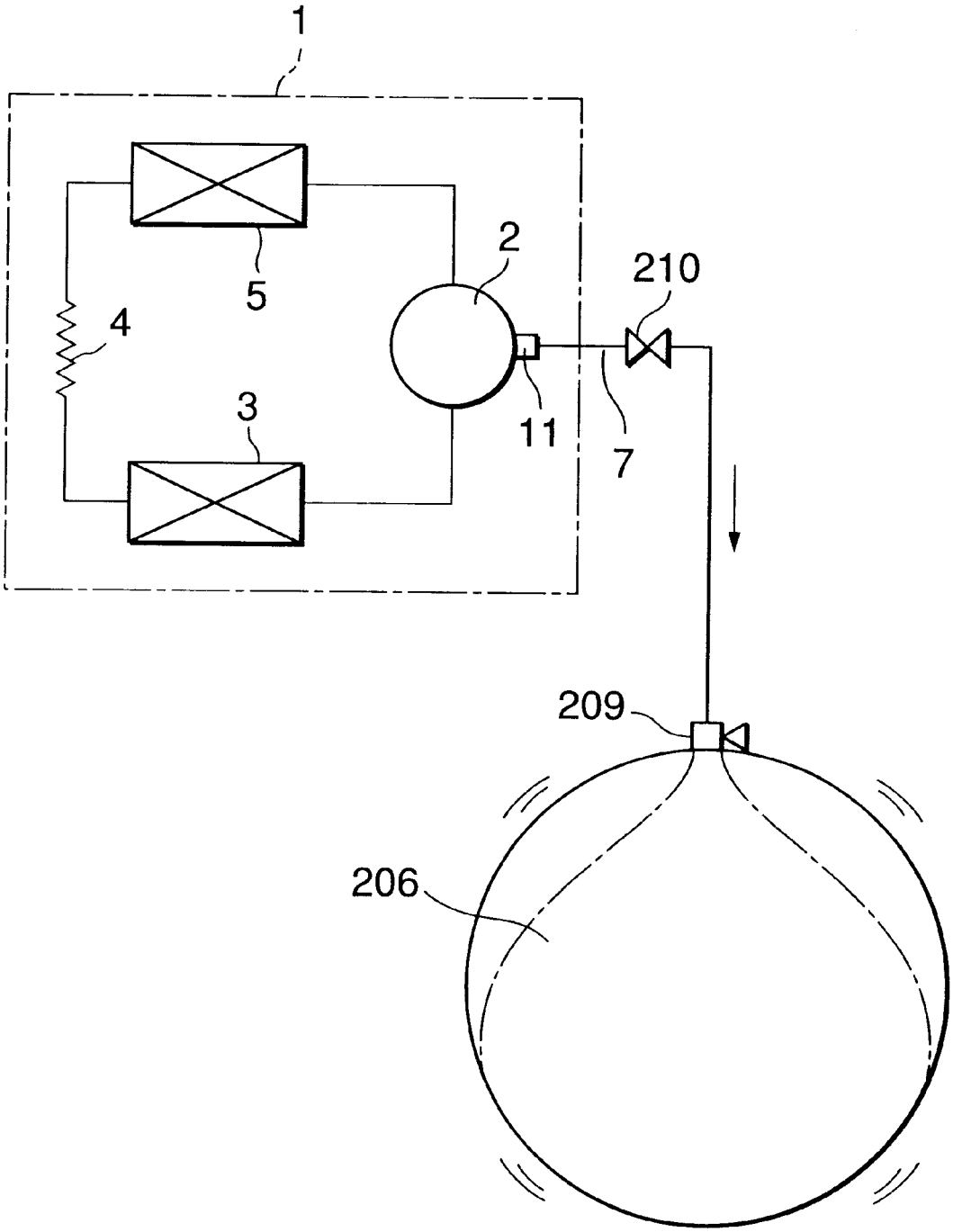
FIG. 27 is an explanatory view showing that a refrigerant recovery bag shown in FIG. 26 is connected to the known refrigerant recovery machine.

Additionally, FIGS. 26 and 27 are explanatory views showing a conventional refrigerant recovery method. In the drawings, numeral 209 denotes a connector for connecting the pipeline 7 to a refrigerant recovery bag 206, and 210 denotes an opening/closing valve.

Then, in the case of recovering the refrigerants in the refrigerant circuit, when the refrigerant recovery bag 206 is connected to the compressor 2 and the opening/closing valve 210 is opened, the refrigerants flow in the direction shown by an arrow and enter the refrigerant recovery bag 206, so that substantially all the refrigerants in the refrigerant circuit can be recovered into the refrigerant recovery bag 206. After the refrigerants are recovered into the refrigerant recovery bag 206, the refrigerant recovery bag 206 is removed, this refrigerant recovery bag 206 is connected to a known refrigerant recovery machine provided with the vacuum pump, bomb, and the like as described later, the vacuum pump of the refrigerant recovery machine is operated to suck the refrigerants to the outside of the refrigerant recovery bag 206, and the refrigerants are liquefied and placed into the bomb for recovery.

In this method, however, when the refrigerants are placed into the refrigerant recovery bag 206, the bag largely bulges to increase its volume and disadvantageously becomes difficult to be handled. Moreover, when the refrigerant recovery bag 206 is repeatedly used, a problem is that the bag is torn.

Furthermore, there is no problem when a large number of used household refrigerators, and the like are collected and treated in the place where the refrigerant recovery machine is installed. However, the refrigeration apparatus in a remote area, the industrial refrigeration apparatus, particularly the apparatuses with special refrigerants sealed therein such as the medical apparatus are collected with difficulty. It is troublesome to convey the large and heavy refrigerant recovery machine to the remote area, and it is also troublesome and laborious to bring the largely bulged refrigerant recovery bag 206 with an increased volume back to the place where the refrigerant recovery machine is installed, which causes a problem of an increase in costs. However, all the problems can be solved according to the present invention.

Figure 22:
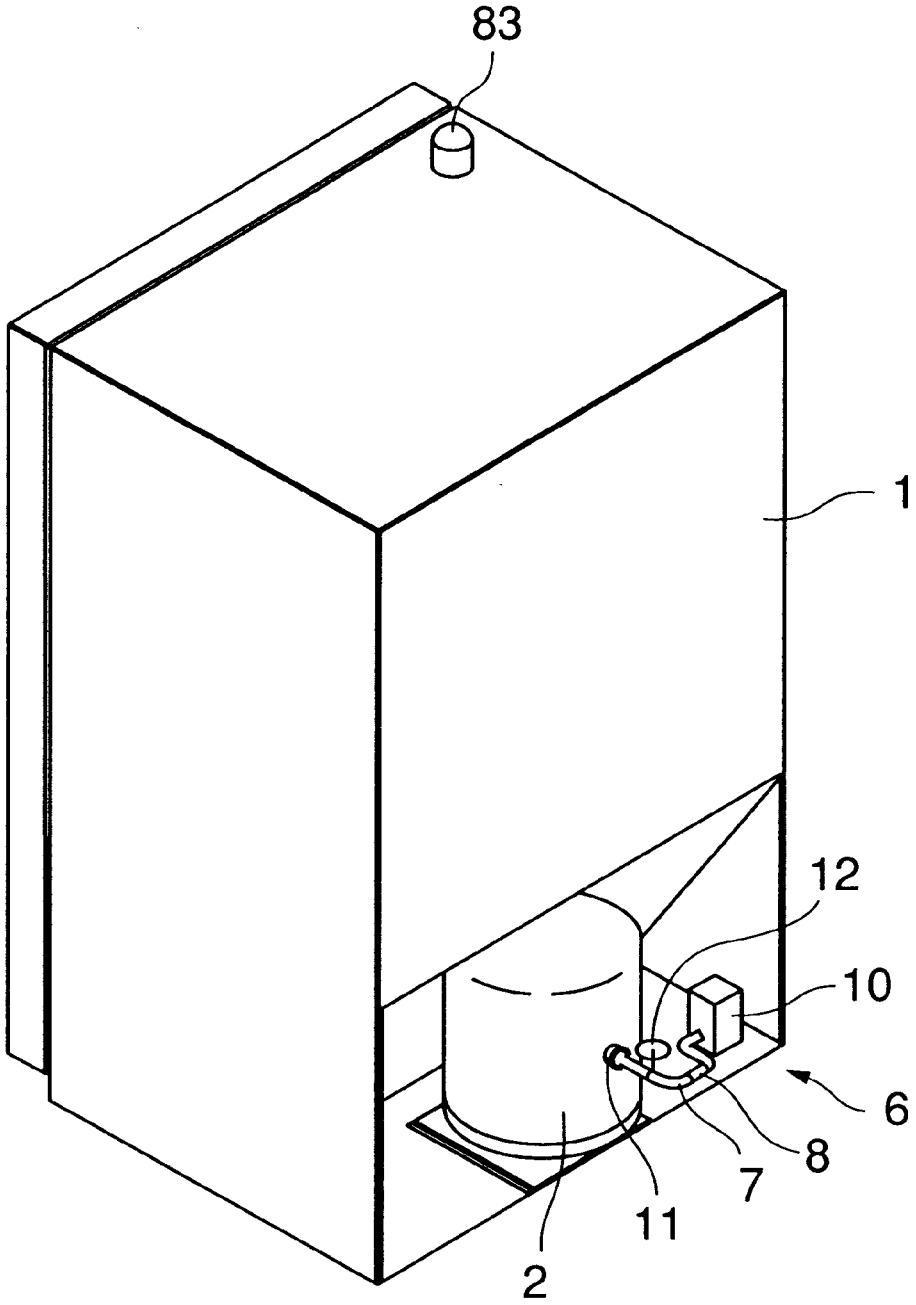
FIG. 22 is an explanatory view showing another embodiment of the refrigeration apparatus provided with the refrigerant recovery apparatus of the present invention.

Next, FIG. 22 is an explanatory view showing the embodiment of another refrigeration apparatus of the present invention. Additionally, other respects are similar to FIG. 2. In FIG. 22, numeral 1 denotes a refrigerator with the compressor 2 mounted thereon. The compressor 2 is successively connected to the condenser 3, the capillary tube 4 and the evaporator 5 to constitute the refrigerant circuit. One end of the pipeline 7 of the refrigerant recovery apparatus 6 is connected to the tip end of the seal pipe 11 for sealing the refrigerants to the compressor 2 of the refrigerator 1. Numeral 12 denotes a pressure gauge, and 83 denotes an alarm lamp.

The refrigerant recovery apparatus 6 is constituted of the pipeline 7 having one end connected to the refrigerant circuit, the opening/closing valve (solenoid valve) 8 disposed on the pipeline 7, the refrigerant recovery main body 10 containing the solid adsorbent 9 which can selectively adsorb the refrigerants in the refrigerant circuit, and the like.

In the above constitution, when at least one sensor (not shown) disposed in spaces such as the inside of the refrigerator 1 and/or a room (not shown) in which the refrigerator 1 is installed detects the refrigerants leaking from the refrigerant circuit, the sensor transmits a signal to a controller (not shown). When the detected leakage amount, leakage continuation time, leakage pattern, and the like exceed predetermined reference values, and the like, the controller transmits a signal to the opening/closing valve 8 to open the opening/closing valve 8 and to light the alarm lamp 83, thereby operating an alarm buzzer (not shown).

When the opening/closing valve 8 is opened, the refrigerants in the refrigerant circuit of the refrigerator 1 (the Freon refrigerants, hydrocarbons, helium, ammonia, air, and the like) immediately flow in the direction shown by the arrow of FIG. 2 without using any suction pump, so that substantially all the refrigerants in the refrigerant circuit are adsorbed to the solid adsorbent 9 and recovered into the refrigerant recovery main body 10. The refrigerants adsorbed to the solid adsorbent 9 are adsorbed in an irreversible manner, and fail to be naturally desorbed, so that various dangers can be prevented beforehand, such as the ozone layer damage, earth warming, refrigeration ability deterioration, and the like caused by the leakage, further malodors, explosions, fires, and adverse influences on human bodies.

In the above constitution, the example in which when at least one sensor detects the refrigerant leakage from the refrigerant circuit, the opening/closing valve 8 is automatically opened has been described, but when the alarm lamp 83 lights, or when the alarm buzzer (not shown) rings, the opening/closing valve 8 may manually be opened.

When the refrigerants in the refrigerant circuit of the refrigerator 1 are allowed to contain index substances such as a colored substance, a marking substance, and an odorous substance, it can be distinguished and detected by the sensor whether the leaked refrigerants are attributed to the refrigerator 1 or other causes.

Figure 23:
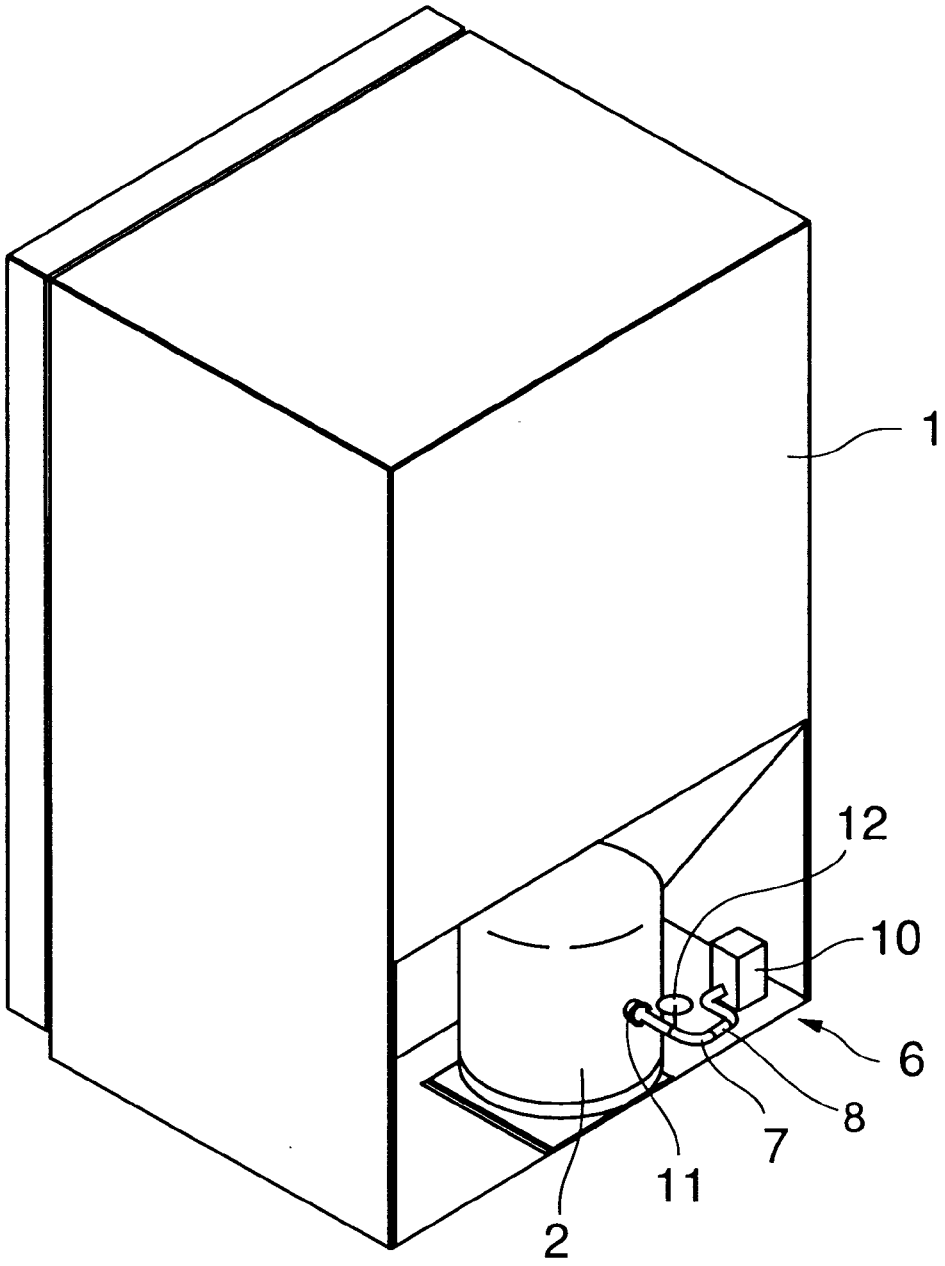
FIG. 23 is an explanatory view showing still another embodiment of the refrigeration apparatus provided with the refrigerant recovery apparatus of the present invention.
Figure 24:
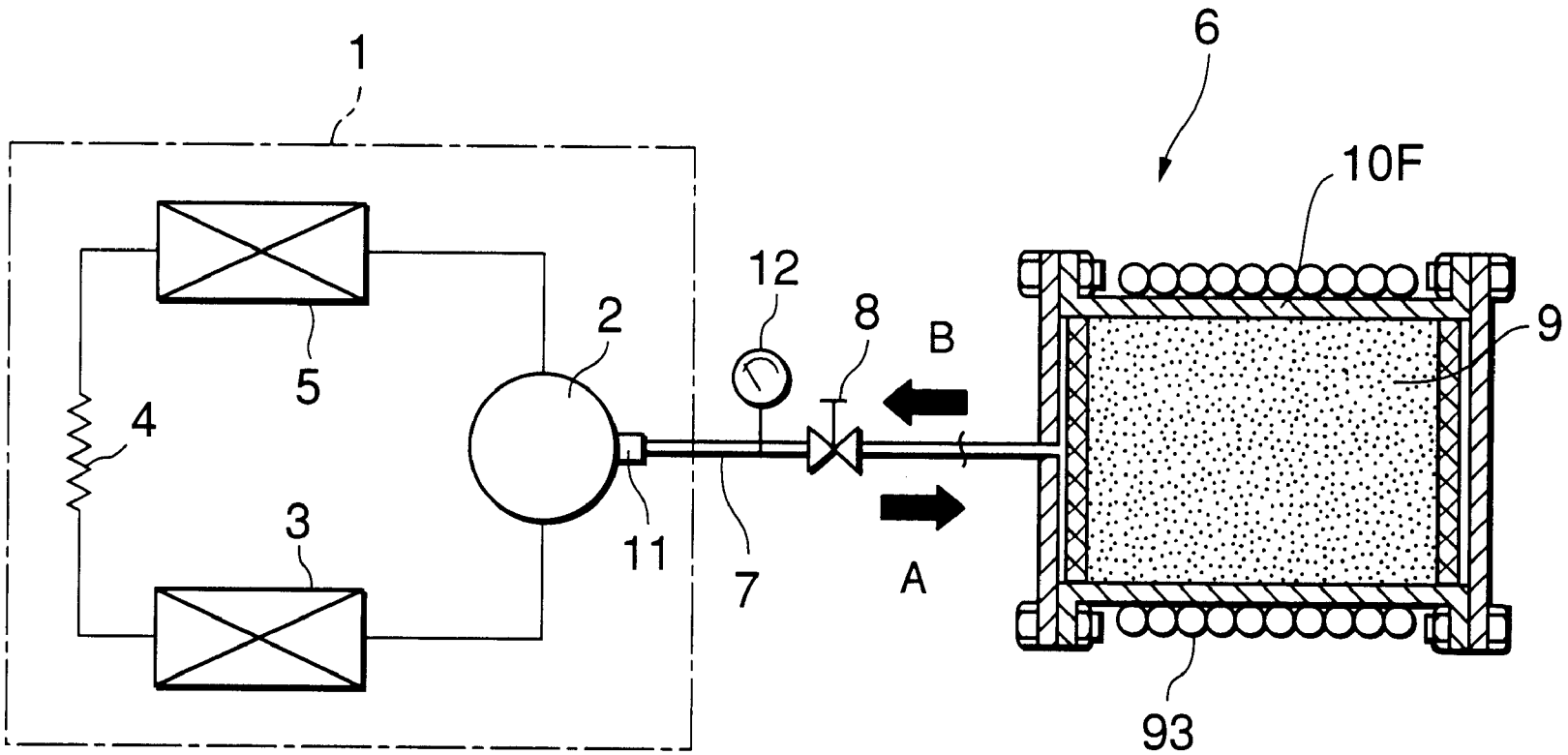
FIG. 24 is an explanatory view showing that the refrigerant recovery apparatus is connected to the refrigerant circuit of the refrigeration apparatus shown in FIG. 23.

Next, FIG. 23 is an explanatory view showing the refrigeration apparatus provided with another refrigerant recovery apparatus of the present invention, and FIG. 24 is an explanatory view showing that this refrigerant recovery apparatus is connected to the refrigerant circuit of the refrigeration apparatus shown in FIG. 23. Additionally, in the drawing the same reference numerals as those described above denote the same components.

Specifically, in FIGS. 23 and 24, numeral 1 denotes a refrigerator with the compressor 2 mounted thereon. The compressor 2 is successively connected to the condenser 3, the capillary tube 4 and the evaporator 5 to constitute the refrigerant circuit. One end of the pipeline 7 of the refrigerant recovery apparatus 6 of the present invention is connected to the tip end of the seal pipe 11 for sealing the refrigerants to the compressor 2 of the refrigerator 1. Numeral 12 denotes a pressure gauge.

This refrigerant recovery apparatus 6 is constituted of the pipeline 7 having one end connected to the refrigerant circuit, the opening/closing valve 8 disposed on the pipeline 7, the refrigerant recovery main body 10 containing the solid adsorbent 9 which can adsorb the refrigerants in the refrigerant circuit, heating means 93 for heating the solid adsorbent 9, and the like.

Next, an example in which this refrigerant recovery apparatus 6 is used to control the amount of refrigerants in the refrigerant circuit will be described.

In this constitution, for example, when the sensor (not shown) disposed inside the refrigerator 1 detects the refrigerants leaking from the refrigerant circuit, the sensor transmits a signal to the controller (not shown), and the detected leakage amount, leakage continuation time, leakage pattern, and the like exceed the predetermined reference values, and the like, the controller transmits a signal to the opening/closing valve 8 to open the opening/closing valve 8.

When the opening/closing valve 8 is opened, the refrigerants in the refrigerant circuit of the refrigerator 1 (the HCFC refrigerant, HFC refrigerant, FC refrigerant, hydrocarbon refrigerant and mixture refrigerant constituted of at least one type of refrigerant selected from these refrigerants, helium, ammonia, and other refrigerants) immediately flow in the direction shown by arrow A of FIG. 24 without using any suction pump, so that substantially all the refrigerants in the refrigerant circuit are adsorbed to the solid adsorbent 9 and recovered into the refrigerant recovery main body 10. Since the refrigerants adsorbed to the solid adsorbent 9 fail to be naturally desorbed, various dangers by the leakage can be prevented beforehand as described above.

As another example of disposing the sensor to detect the refrigerant leakage, an example in which the evaporator 5 in the refrigerant circuit is provided with a temperature sensor can be exemplified. When this temperature sensor detects the lack of refrigeration ability of the evaporator 5, the refrigerant leakage is considered. Therefore, the opening/closing valve 8 is opened based on the signal from the sensor as described above and the total amount of refrigerants in the refrigerant circuit are adsorbed to the solid adsorbent 9.

Subsequently, after a countermeasure of repairing the leakage place, and the like are performed to complete the measure against dangers and the safety is confirmed, the signal is transmitted from the controller to open the opening/closing valve 8, the solid adsorbent 9 is heated by the heating means 93, the refrigerants adsorbed to the solid adsorbent 9 are desorbed, passed in the direction shown by arrow B of FIG. 24 and returned into the refrigerant circuit, and the refrigerants are reused. Of course, the opening/closing of the opening/closing valve 8 may manually be performed.

Figure 25:
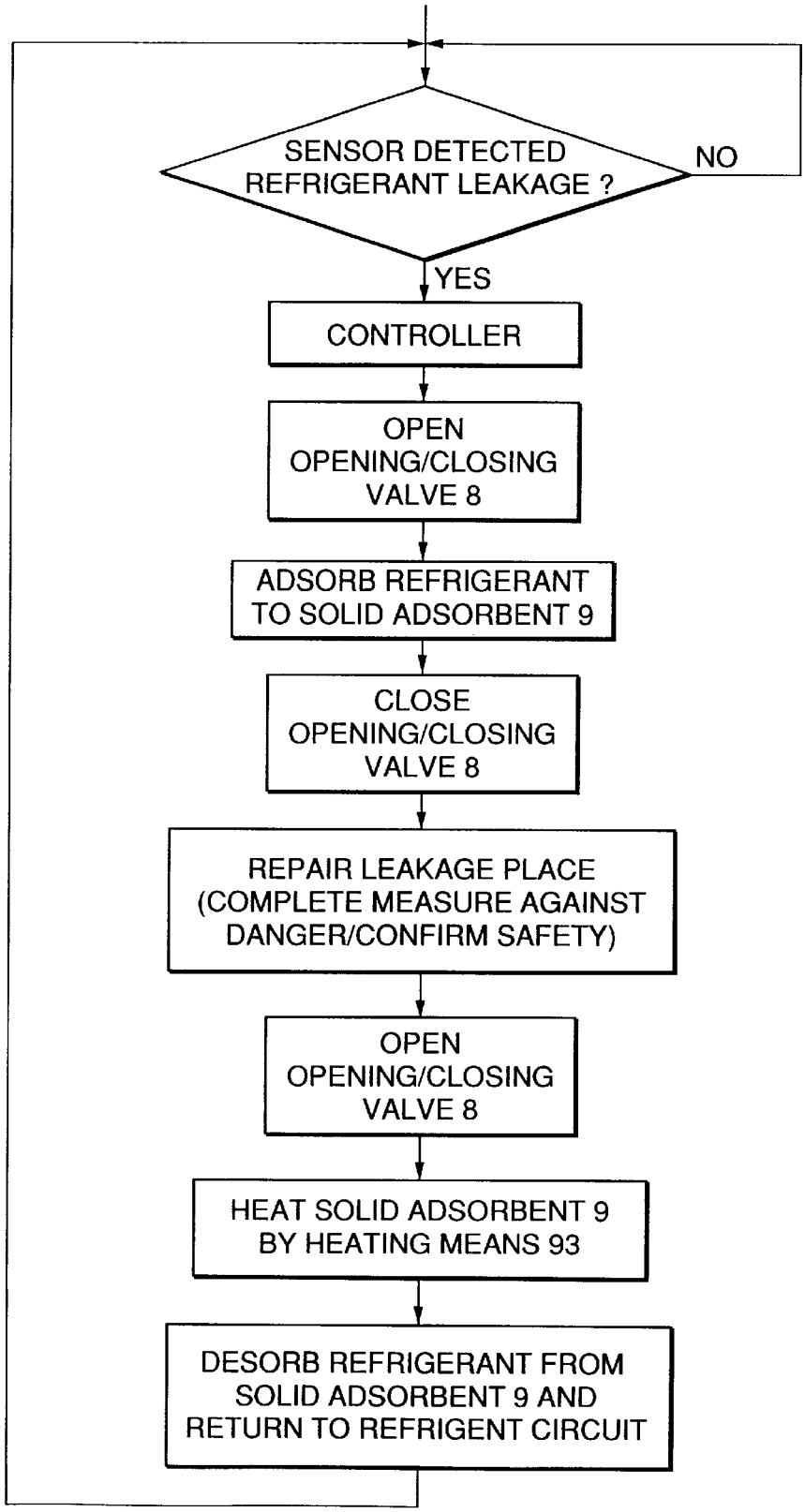
FIG. 25 is a flowchart showing one example for using the refrigerant recovery apparatus of the present invention to control the amount of refrigerants in the refrigerant circuit.

FIG. 25 is a flowchart showing an example of using this refrigerant recovery apparatus 6 to control the amount of refrigerants in the refrigerant circuit.

The heating means 93 for use in the present invention may be any heating means using any heat source as long as the solid adsorbent 9 can be heated to desorb the refrigerants adsorbed to the solid adsorbent 9, and may heat the solid adsorbent 9 from the outside of the refrigerant recovery main body 10, or may heat the solid adsorbent 9 from the inside of the refrigerant recovery main body 10, and the form, shape, capacity, and the like are not especially limited.

Concrete examples of the heating means 93 include the means which use an electric heater, Peltier effect, and the heat of discharge refrigerants of the compressor 2 of the refrigerant circuit.

In the present invention, for the solid adsorbent 9, the solid adsorbent which can selectively adsorb the refrigerants is preferably used in accordance with the refrigerants present in the refrigerant circuit. The solid adsorbent which can selectively adsorb the refrigerants are as described above, but as other examples of providing the solid adsorbent with the selective adsorptivity, an example of depositing ultra-fine particles on the surface of active carbon or another solid adsorbent through coating can be exemplified.

Such ultra-fine particles are not especially limited, but there can be exemplified metallic ultra-fine particles such as Ti, Ni and Al of diameters of nanometer order or angstrom order which are produced using a thin film deposition method in a semiconductor field. In the present invention, the artificial solid adsorbent which is provided with the selective adsorptivity by depositing the ultra-fine particles on the surface of the active carbon or another solid adsorbent through coating or the like can be used as the solid adsorbent.

Another example of using the refrigerant recovery apparatus of the present invention to control the amount of refrigerants in the refrigerant circuit when the refrigerant in the refrigerant circuit is a mixture refrigerant constituted of combustible refrigerants such as hydrocarbon and incombustible refrigerants such as HFC refrigerant will next be described.

When only the solid adsorbent 9 which can selectively adsorb the combustible refrigerants is contained in the refrigerant recovery main body 10, and the leakage of the mixture refrigerant is detected by the sensor or the like as described above during the operation of the refrigerator 1, the opening/closing valve 8 is opened as described above, and only the combustible refrigerants in the mixture refrigerant are adsorbed to the solid adsorbent 9. Subsequently, when a predetermined amount of combustible refrigerants are adsorbed, the mixture ratio of combustible refrigerants in the mixture refrigerant remaining in the refrigerant circuit decreases, and the mixture refrigerant remaining in the refrigerant circuit is in an incombustible area, the opening/closing valve 8 is closed.

In this case, the operation can be continued. Additionally, even when the opening/closing valve 8 is closed and the operation of the refrigerator 1 is continued, the safety is maintained, because the mixture refrigerant remaining in the refrigerant circuit is incombustible. Subsequently, after the repair or the like is completed, and the safety is confirmed, the opening/closing valve 8 is opened by transmitting the signal from the controller or by manual operation, the solid adsorbent 9 is heated by the heating means 93, and the combustible refrigerants adsorbed to the solid adsorbent 9 are desorbed, returned to the refrigerant circuit and used.

Another example of using the refrigerant recovery apparatus 6 of the present invention to control the amount of refrigerants in the refrigerant circuit when the refrigerant in the refrigerant circuit is a mixture refrigerant of two types of HFC refrigerants will next be described.

When the refrigerants in the refrigerant circuit are mixture refrigerants such as R-410 and R-407 constituted of R-125 and R-32, the operation is started by the mixture refrigerants such as R-410 and R-407, and in a steady operation stage, the operation is performed by adsorbing a predetermined amount of R-125 in the mixture refrigerant to the refrigerant recovery main body 10 containing only the solid adsorbent 9 which can selectively adsorb R-125 to raise the mixture ratio of R-32.

When the refrigerants with an enhanced mixture ratio of R-32 are used to perform the operation, the refrigeration efficiency can be enhanced as compared with when the mixture refrigerants such as R-410 and R-407 are used to perform the operation. During the operation stop or before the operation start, the solid adsorbent 9 is heated by the heating means 93, and R-125 adsorbed to the solid adsorbent 9 is desorbed, returned into the refrigerant circuit and used.

Another example of using the refrigerant recovery apparatus 6 of the present invention to control the amount of refrigerants in the refrigerant circuit will next be described.

While the opening/closing valve 8 of the refrigerant recovery apparatus 6 of the present invention remains to be opened, and a part of the refrigerant in the refrigerant circuit is adsorbed to the solid adsorbent 9, the operation of the refrigerator 1 is started, and after the start, the solid adsorbent 9 is heated by the heating means 93, the refrigerants adsorbed to the solid adsorbent 9 are desorbed and returned into the refrigerant circuit, and the opening/closing valve 8 is then closed to perform the operation. In this case, the burden of the compressor 2 during the start can be reduced. Therefore, even when the compressor 2 provided with a small-capacity motor is used, substantially the same refrigeration efficiency can be obtained as that of the compressor 2 provided with a large-capacity motor, thereby realizing the reduction of power consumption, size and noises.

In this case, the refrigerant recovery apparatus 6 may be connected to the refrigerant circuit in series. While the operation is stopped, a part of the refrigerant is adsorbed in the refrigerant recovery apparatus 6, and therefore, even when the operation is started as it is, the burden is reduced.

By heating the refrigerant recovery apparatus 6 after the start, the adsorbed refrigerants are desorbed, and the operation can be performed with a predetermined refrigerant pressure.

In this case, by utilizing the heat of the discharge refrigerant of the compressor 2 to heat the refrigerant recovery apparatus 6, another particular heat source does not need to be used. Additionally, when the refrigerant circuit is in a steady state, heating is naturally performed, so that any special control circuit is unnecessary.

Additionally, since the present invention is not limited to the above-described embodiments, various modifications are possible without departing from the scope of the appended claims.

Possibility of Industrial Utilization

According to the present invention, since the tip end of the pipeline of the refrigerant recovery apparatus is provided with the clamping/piercing function valve, in the case in which the refrigerants in the refrigerant circuit need to be recovered because of the used refrigerator and for other reasons, by operating the clamping/piercing function valve to make a small hole in the appropriate place of the refrigerant circuit, the refrigerant can easily be adsorbed to the solid adsorbent and recovered at a low cost without using any suction pump. Since this obviates the necessity of the opening/closing valve, the structure of the refrigerant recovery apparatus can remarkably be simplified.

Moreover, when the refrigerant recovery main body of the refrigerant recovery apparatus of the present invention is color-coded in accordance with the refrigerant type, the type of the refrigerant which can selectively be adsorbed can conveniently be known by the color, and the refrigerant recovery main bodies to be combined for use in adsorbing and recovering the mixture refrigerant can easily be selected.

Moreover, by using the refrigerant recovery apparatus of the present invention provided with two or more refrigerant recovery main bodies containing the solid adsorbents which can selectively adsorb different refrigerants in different refrigerant recovery main bodies, even when the refrigerant in the refrigerant circuit is a mixture of different refrigerants, the refrigerants can easily be recovered.

Furthermore, by using the refrigerant recovery apparatus of the present invention in which a plurality of solid adsorbents which can selectively adsorb different refrigerants are contained in one refrigerant recovery main body, even when the refrigerant in the refrigerant circuit is a mixture of different refrigerants, the refrigerants can collectively and easily be recovered.

Moreover, since the solid adsorbent is a powdery, particulate, fibrous, or molded active carbon, gas adsorbent resin, clay, active alumina, molecular sieve, bone charcoal, China clay or silica gel, or the mixture of two or more of these, it is superior in safety, handling properties, refrigerant adsorption performance, and the like, and it is easy to obtain and is economical.

Moreover, heat is generated during the adsorbing/recovering of the refrigerants, but by using the refrigerant recovery apparatus of the present invention structured so that air-cooling and/or water-cooling can be performed, cooling is performed during the adsorbing/recovering of the refrigerants so that the refrigerants can efficiently and easily be recovered.

In the refrigeration apparatus provided beforehand with the refrigerant recovery apparatus of the present invention, in the case in which the refrigerants in the refrigerant circuit need to be recovered because it has been used and for other reasons, the refrigerant recovery apparatus of the present invention does not have to be carried. By opening the installed opening/closing valve, or operating the pierce/pinch tube passing valve to make the small hole in the appropriate place of the refrigerant circuit, substantially all the refrigerants in the refrigerant circuit can efficiently be recovered into the refrigerant recovery main body without using any suction pump.

Moreover, in the refrigeration apparatus provided with the refrigerant recovery apparatus of the present invention, when at least one sensor disposed in the spaces such as the inside of the refrigeration apparatus and/or the room in which the refrigeration apparatus is installed detects the refrigerants leaking from the refrigerant circuit, the opening/closing valve is opened based on the signal from the sensor to connect the refrigerant circuit and the refrigerant recovery apparatus, and the refrigerants in the refrigerant circuit are adsorbed to the solid adsorbent, so that the ozone layer damage, earth warming, refrigeration ability deterioration, and the like caused by the refrigerant leakage can be prevented beforehand before causing the malodors, explosions, fires, adverse influences on human bodies, and the like.

Particularly, when the refrigerants are combustible hydrocarbons such as propane, butane, and pentane or natural refrigerants such as ammonia, the leakage results in a large danger, but the sensor detects the refrigerant leakage from the refrigerant circuit, and this sensor transmits a signal to the controller. When the detected leakage amount, leakage continuation time, leakage pattern, and the like exceed the predetermined reference values, and the like, the controller transmits a signal to the opening/closing valve to open the opening/closing valve, and the total amount of refrigerants in the refrigerant circuit are immediately recovered to the refrigerant recovery apparatus, so that the dangers can be prevented beforehand.

When the index substances are contained in the refrigerants in the refrigerant circuit of the refrigeration apparatus of the present invention, it can be distinguished and detected by the sensor whether the leaked refrigerants are attributed to this refrigeration apparatus, or other causes.

When the sensor detects the refrigerants leaking from the refrigerant circuit, by operating the alarm lamp or the alarm buzzer based on the signal from the sensor, the danger can be known early and handled.

Furthermore, the refrigerant recovery apparatus of the present invention has a simple constitution, and can easily control the amount, blend ratio, and the like of the refrigerants in the refrigerant circuit. When the refrigerants leak from the refrigerant circuit and the danger of causing the adverse influences is generated, and particularly when the refrigerants are combustible hydrocarbons such as propane, butane, and pentane, combustible HFC refrigerants or natural refrigerants such as ammonia, the refrigerants in the refrigerant circuit are immediately recovered to the main body, so that the danger can be prevented beforehand. After the measure against the danger is completed, and the safety is confirmed, the refrigerants recovered to the main body are heated by the heating means, desorbed, returned into the refrigerant circuit, and can be used. By controlling the amount of refrigerants in the refrigerant circuit, the mixture ratio of the mixture refrigerant, and the like, the starting property, energy saving effect, refrigeration efficiency, and the like can be enhanced. Moreover, the refrigerant recovery apparatus of the present invention can be expected to play a role as an expansion tank or an unloader.

Moreover, when the solid adsorbent for selectively adsorbing the predetermined refrigerant out of the mixture refrigerants of hydrocarbon fluoride refrigerants and/or hydrocarbon refrigerants, and the like is used, by controlling the amount of mixture refrigerants in the refrigerant circuit or the mixture ratio, the safety, starting property, energy saving effect, refrigeration efficiency, and the like can be enhanced.

Furthermore, the refrigerant selective adsorptivity can be provided by depositing the ultra-fine particles on the surface of the solid adsorbent through coating or the like.

Additionally, when the heating means utilizes the heat of the discharge refrigerant of the compressor of the refrigerant circuit, the heat can easily be used, and the energy saving effect can be raised.

Moreover, when the evaporator in the refrigerant circuit is provided with the temperature sensor, and the temperature sensor detects the lack of refrigeration ability of the evaporator, the opening/closing valve is opened based on the signal from the sensor and the total amount of refrigerants in the refrigerant circuit are adsorbed to the solid adsorbent, so that the safety can be enhanced.

Furthermore, according to the control method of the refrigerants in the refrigerant circuit of the present invention, the amount, blend ratio, and the like of the refrigerants in the refrigerant circuit can easily be controlled, and the safety, starting property, energy saving effect, refrigeration efficiency, and the like can be enhanced.

What is claimed is:

1. A refrigeration apparatus comprising:

a refrigerant recovery apparatus comprising a pipeline connected to a refrigerant circuit, an opening/closing valve disposed in the pipeline, and a refrigerant recovery main body connected to said pipeline and containing a solid adsorbent which can selectively adsorb a refrigerant in the refrigerant circuit, at least one sensor disposed in spaces such as said refrigeration apparatus and/or a room in which said refrigeration apparatus is installed to detect and produce a signal upon detection of refrigerant leaking from the refrigerant circuit, and wherein said opening/closing valve is opened responsive to the signal from said at least one sensor to connect the refrigerant circuit and said refrigerant recovery apparatus, and the refrigerant in the refrigerant circuit is adsorbed in said solid adsorbent; and an alarm lamp and/or an alarm buzzer, wherein when said sensor detects the refrigerant leaking from the refrigerant circuit, said alarm lamp and/or the alarm buzzer is operated based on the signal from said sensor.

2. A refrigerant recovery apparatus comprising:

a pipeline connected to a refrigerant circuit; a refrigerant recovery main body connected to said pipeline and containing a solid adsorbent which can adsorb/desorb a refrigerant in the refrigerant circuit; and heating means for heating the solid adsorbent wherein the refrigerant in said refrigerant circuit comprises a mixture of refrigerants, and said solid adsorbent selectively adsorbs a predetermined refrigerant from among the mixture of refrigerants, and wherein said solid adsorbent is provided with a selective adsorptivity by depositing ultrafine particles through a coating.

3. A refrigerant recovery apparatus as in claim 2 wherein said solid adsorbent is contained in a sealed container, and a vacuum is drawn inside the sealed container.

4. The refrigerant recovery apparatus according to claim 3 wherein said sealed container comprises a pipeline on the tip end of which a valve with a clamping/piercing function is disposed.

5. The refrigerant recovery apparatus according to claim 2 wherein the refrigerant in said refrigerant circuit comprises a hydrocarbon fluoride refrigerant and/or a hydrocarbon refrigerant.

6. The refrigerant recovery apparatus according to claim 2 wherein the refrigerant in said refrigerant circuit comprises a mixture refrigerant, and said solid adsorbent selectively adsorbs a predetermined refrigerant among the mixture refrigerant.

7. The refrigerant recovery apparatus according to claim 2, further comprising a temperature sensor disposed in an evaporator in said refrigerant circuit, and when said temperature sensor detects a lack of refrigeration ability of said evaporator, said opening/closing valve disposed in said pipeline is opened based on a signal from said temperature sensor and the total amount of refrigerants in the refrigerant circuit is adsorbed by the solid adsorbent.

8. A refrigerant recovery apparatus comprising: a pipeline connected to a refrigerant circuit; a refrigerant recovery main body connected to said pipeline for containing a solid adsorbent which can adsorb/desorb a refrigerant in the refrigerant circuit; and heating means for heating the solid adsorbent, wherein said heating means utilizes heat of a discharge refrigerant of a compressor in said refrigerant circuit.

9. The refrigerant recovery apparatus according to claim 8 wherein said refrigerant recovery main body is color-coded in accordance with a refrigerant type which can be adsorbed.

10. The refrigerant recovery apparatus according to claim 8 comprising: two or more refrigerant recovery main bodies so that the solid adsorbent is able to selectively adsorb different refrigerants that are contained in different refrigerant recovery main bodies.

11. The refrigerant recovery apparatus according to claim 8 further comprising: a plurality of solid adsorbents in said refrigerant recovery main body which are able to selectively adsorb different refrigerants.

12. The refrigerant recovery apparatus according to claim 8 wherein said solid adsorbent is selected from the group consisting of powdery, particulate, fibrous, and molded active carbon, gas adsorbent resin, clay, active alumina, molecular sieve, bone charcoal, China clay, silica gel, and a mixture of two or more of these components.

13. The refrigerant recovery apparatus according to claim 8 wherein said refrigerant recovery main body is structured such that air-cooling and/or water-cooling can be performed.

14. A refrigeration apparatus which comprises the refrigerant recovery apparatus according to claim 8.

15. A refrigerant recovery apparatus according to claim 8 which comprises: a heating apparatus for heating one of said refrigerant recovery main body and said refrigerant recovery apparatus that has adsorbed the refrigerant; a pipeline with one end connected to said refrigerant recovery main body for discharging a desorbed refrigerant; a cooling apparatus disposed midway in the pipeline; and a refrigerant container connected to the other end of said pipeline.

16. A refrigerant recovery apparatus as in claim 8 in combination with a refrigeration apparatus wherein said refrigerant recovery apparatus further comprises an opening/closing valve disposed in the pipeline, and wherein said refrigerant recovery main body contains a solid adsorbent which can selectively adsorb a refrigerant in the refrigerant circuit; and at least one sensor disposed in spaces, such as said refrigeration apparatus and/or a room in which said refrigeration apparatus is installed, to detect and produce a signal upon detection of refrigerant leaking from the refrigerant circuit, wherein said opening/closing valve is opened responsive to the signal from said at least one sensor to connect the refrigerant circuit and said refrigerant recovery apparatus, and the refrigerant in the refrigerant circuit is adsorbed in said solid adsorbent.

17. The refrigerant recovery apparatus according to claim 16 wherein the refrigerants are natural refrigerants, such as hydrocarbons including ammonia, propane, and butane.

18. The refrigerant recovery apparatus according to claim 17 wherein the refrigerant contains an index substance.

19. A refrigerant recovery apparatus comprising: a pipeline connected to a refrigerant circuit; an opening/closing valve disposed in the pipeline; a refrigerant recovery main body connected to said pipeline for containing a solid adsorbent which can adsorb/desorb a refrigerant in the refrigerant circuit; and heating means for heating the solid adsorbent, wherein a temperature sensor is disposed in an evaporator in said refrigerant circuit such that when the temperature sensor detects a lack of refrigeration ability of said evaporator, the opening/closing valve disposed in said pipeline is opened based on the signal from said sensor and the total amount of refrigerants in the refrigerant circuit are adsorbed to the solid adsorbent.

* * * * *

UNITED STATES PATENT AND TRADEMARK OFFICE

CERTIFICATE OF CORRECTION

PATENT NO. : 6,449,962 B1
DATED : September 17, 2002
INVENTOR(S) : Kazuo Takemasa et al.

It is certified that error appears in the above-identified patent and that said Letters Patent is hereby corrected as shown below:

Title page,
Item [54], Title, -- REFRIGERANT COLLECTING DEVICE, REFRIGERANT COLLECTING METHOD, REFRIGERATOR HAVING REFRIGERANT COLLECTING DEVICE, CONTROL METHOD FOR REFRIGERANT IN REFRIGERANT CIRCUIT OR REGENERATION DEVICE AND REGENERATION METHOD FOR REFRIGERANT COLLECTING --
should be -- REFRIGERANT RECOVERY APPARATUS, REFRIGERANT RECOVERY METHOD, REFRIGERATION APPARATUS PROVIDED WITH REFRIGERANT RECOVERY APPARATUS, CONTROL METHOD OF REFRIGERANT IN REFRIGERANT CIRCUIT OR RECYCLING APPARATUS AND RECYCLING METHOD OF REFRIGERANT RECOVERY APPARATUS --

Signed and Sealed this

Eleventh Day of March, 2003

JAMES E. ROGAN
*Director of the United States Patent and Trademark Office*